US008419395B2

(12) United States Patent
Furusho et al.

(10) Patent No.: US 8,419,395 B2
(45) Date of Patent: Apr. 16, 2013

(54) COMPRESSOR AND REFRIGERATION APPARATUS

(75) Inventors: Kazuhiro Furusho, Sakai (JP); Yoshitaka Shibamoto, Sakai (JP); Takashi Shimizu, Sakai (JP); Takazou Sotojima, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 416 days.

(21) Appl. No.: 12/865,666

(22) PCT Filed: Feb. 4, 2009

(86) PCT No.: PCT/JP2009/000433

§ 371 (c)(1),
(2), (4) Date: Jul. 30, 2010

(87) PCT Pub. No.: WO2009/098874

PCT Pub. Date: Aug. 13, 2009

(65) Prior Publication Data

US 2010/0319394 A1 Dec. 23, 2010

(30) Foreign Application Priority Data

Feb. 4, 2008 (JP) ..... 2008-023704
Sep. 29, 2008 (JP) ..... 2008 250950

(51) Int. Cl.
*F04C 2/00* (2006.01)
*F04C 15/00* (2006.01)

(52) U.S. Cl.
USPC ..... 418/107; 418/12; 418/59

(58) Field of Classification Search ..... 418/11–12, 418/55.5, 57–59, 107; 417/410.3, 410.1
See application file for complete search history.

(56) References Cited

U.S. PATENT DOCUMENTS 5,329,788 A * 7/1994 Caillat et al. ..... 418/57
2007/0041852 A1 2/2007 Masuda
2008/0240958 A1 10/2008 Masuda
2009/0013714 A1 1/2009 Yamaguchi et al.

FOREIGN PATENT DOCUMENTS

JP 62-173585 U 11/1987
JP 2005-320927 A 11/2005
JP 2005-320929 A 11/2005
JP 2007-239666 A 9/2009

OTHER PUBLICATIONS

International Search Report of corresponding PCT Application No. PCT/JP2009/000433, Apr. 28, 2009.

* cited by examiner

*Primary Examiner* — Theresa Trieu
(74) *Attorney, Agent, or Firm* — Global IP Counselors

(57) ABSTRACT

A compressor includes a compression mechanism having lower and upper stage compression chambers. Refrigerant compressed in the lower-stage compression chamber is further compressed in the higher-stage compression chamber. An intermediate injection pipe is arranged to inject refrigerant between the lower-stage and the higher-stage compression chambers. The compression mechanism includes at least one fixed member having a fixed end plate, and at least one movable member having a movable end plate section facing the fixed end plate with at least one of the compression chambers interposed between the end plate sections. At least one intermediate back pressure chamber is formed to face a back surface of the movable end plate section. The intermediate back pressure chamber communicates with a discharge side of the lower-stage compression chamber, and is arranged such that internal pressure of the intermediate back pressure chamber acts on the movable end plate section.

7 Claims, 11 Drawing Sheets

COMPRESSOR AND REFRIGERATION APPARATUS

CROSS-REFERENCE TO RELATED APPLICATIONS

This U.S. National stage application claims priority under 35 U.S.C. §119(a) to Japanese Patent Application Nos. 2008-023704, filed in Japan on Feb. 4, 2008, and 2008-250950, filed in Japan on Sep. 29, 2008, the entire contents of which are hereby incorporated herein by reference.

TECHNICAL FIELD

The present invention relates to a compressor performing a two-stage compression of refrigerant, and to a refrigeration apparatus including the compressor.

BACKGROUND ART

Conventionally, a compressor has been known, in which refrigerant is sequentially compressed in compression chambers at lower and higher stages. The compressor of this type includes a compressor in which, on a refrigerant circuit in which a refrigeration cycle is performed, an intermediate injection path for injecting intermediate-pressure refrigerant of the refrigeration cycle into a compression chamber at a higher stage.

For example, Japanese Patent Publication No. 2007-239666 discloses a compressor including two fluid machines. In such a compressor, two compression chambers are formed in each of the first and second fluid machines. In a two-stage compression operation for compressing refrigerant at two stages, a first compression chamber of the first fluid machine and a second compression chamber of the second fluid machine serve as compression chambers at a lower stage, and a third compression chamber of the first fluid machine and a fourth compression chamber of the second fluid machine serve as compression chambers at a higher stage. In the two-stage compression operation, intermediate-pressure refrigerant from an intermediate injection path is mixed with refrigerant compressed in the first and second compression chambers, and then is sent to the third and fourth compression chambers.

In addition, in each of the fluid machines of the compressor of Japanese Patent Publication No. 2007-239666, a cylinder serves a movable member, and a housing including a piston serves as a fixed member. In the fluid machine, the compression chambers are formed between end plate sections of the movable member and of the fixed member.

In the compressor including the end plate sections, when compressing refrigerant, refrigerant pressure in the compression chamber acts on a front surface of the end plate section of the movable member as separating force. Thus, the compressor including the end plate sections is configured such that, in order not to separate the movable member from the fixed member by the separating force, high-pressure refrigerant machine oil is injected into a back surface of the end plate section of the movable member, and then the high-pressure refrigerant machine oil presses the movable member against the fixed member.

SUMMARY

Technical Problem

However, in the conventional compressor including the end plate sections, there is a problem in which, if the intermediate injection path is connected on the refrigerant circuit, pressing force for pressing the movable member against the fixed member becomes excessive as compared to the separating force while an intermediate injection operation for injecting refrigerant from the intermediate injection path into the compression chambers at the higher stage is stopped.

Specifically, while the intermediate injection operation is performed, refrigerant discharged from the compression chambers at the lower stage, and refrigerant from the intermediate injection path flow into the compression chambers at the higher stage. On the other hand, while the intermediate injection operation is stopped, only the refrigerant discharged from the compression chambers at the lower stage flows into the compression chambers at the higher stage. However, the volume of refrigerant sucked into the compression chambers at the higher stage is constant while the intermediate injection operation is performed or stopped, and therefore the compression ratio of refrigerant in the compression chambers at the lower stage while the intermediate injection operation is stopped is smaller than the ratio while the intermediate injection operation is performed. This reduces the pressure of intermediate-pressure refrigerant discharged from the compression chambers at the lower stage. Thus, pressure on discharge sides of the compression chambers at the lower stage, and pressure on suction sides of the compression chambers at the higher stage are reduced, thereby reducing the separating force.

Meanwhile, the pressing force is set so that the movable member is not separated from the fixed member while the intermediate injection operation resulting in the larger separating force is performed. Thus, in the conventional compressor, the pressing force becomes excessive as compared to the separating force while the intermediate injection operation is stopped, thereby increasing an energy loss in a compression mechanism due to friction caused between the movable member and the fixed member.

The present invention has been made in view of the foregoing, and it is an object of the present invention to, in the compressor performing the two-stage compression of refrigerant, reduce the energy loss in the compression mechanism while the intermediate injection operation is stopped.

Solution to the Problem

A first aspect of the invention is intended for a compressor (20) including a compression mechanism (30) which includes lower-stage compression chambers (61, 62) and higher-stage compression chambers (63, 64), and in which refrigerant compressed in the lower-stage compression chambers (61, 62) is further compressed in the higher-stage compression chambers (63, 64). In a refrigerant circuit (10) in which a refrigeration cycle is performed, an intermediate injection pipe (18) for injecting intermediate-pressure refrigerant of the refrigerant circuit (10) between the lower-stage compression chamber (61, 62) and the higher-stage compression chamber (63, 64) is connected.

In the compressor (20), the compression mechanism (30) includes fixed members (51, 52, 55, 56) in which fixed end plate sections (51*a*, 52*a*, 55*a*, 56*a*) facing the compression chambers (61-64) are provided on a base end side; and movable members (51, 52, 55, 56) in which movable end plate sections (51*a*, 52*a*, 55*a*, 56*a*) facing the fixed end plate sections (51*a*, 52*a*, 55*a*, 56*a*) with the compression chambers (61-64) being interposed therebetween are provided on the base end side. The movable members (51, 52, 55, 56) eccentrically rotate to compress refrigerant. The compression mechanism (30) further includes intermediate back pressure chambers (85, 95) which are formed so as to face back surfaces of the movable end plate sections (51*a*, 52*a*, 55*a*, 56*a*), and which communicates with discharge sides of the lower-stage compression chambers (61, 62). Internal pressure of the intermediate back pressure chamber (85, 95) acts on the movable end plate section (51*a*, 52*a*, 55*a*, 56*a*) to press the movable member (51, 52, 55, 56) against the fixed member (51, 52, 55, 56).

A second aspect of the invention is intended for the compressor of the first aspect of the invention, in which the compression mechanism (30) includes a first mechanism section (24) and a second mechanism section (25), each of which includes the fixed members (51, 52, 55, 56) and the movable members (51, 52, 55, 56); and the intermediate back pressure chamber (85, 95) is formed on a back side of the movable end plate section (51*a*, 52*a*, 55*a*, 56*a*) of at least one of the first mechanism section (24) and the second mechanism section (25).

A third aspect of the invention is intended for the compressor of the second aspect of the invention, in which, in the compression mechanism (30), the lower-stage compression chamber (61, 62) and the higher-stage compression chamber (63, 64) are formed in each of the first mechanism section (24) and the second mechanism section (25); and the intermediate back pressure chambers (85, 95) are formed on the back sides of the movable end plate sections (51*a*, 52*a*, 55*a*, 56*a*) of both of the first mechanism section (24) and the second mechanism section (25).

A fourth aspect of the invention is intended for the compressor of the second aspect of the invention, in which, in the compression mechanism (30), the lower-stage compression chambers (61, 62) are formed only in the first mechanism section (24), and the higher-stage compression chambers (63, 64) are formed only in the second mechanism section (25); and the intermediate back pressure chamber (85, 95) is formed on the back side of the movable end plate section (55*a*, 56*a*) of the second mechanism section (25).

A fifth aspect of the invention is intended for the compressor of the fourth aspect of the invention, in which the intermediate back pressure chamber (85, 95) is also formed on the back side of the movable end plate section (51*a*, 52*a*) of the first mechanism section (24).

A sixth aspect of the invention is intended for the compressor of the second aspect of the invention, in which, in the compression mechanism (30), the lower-stage compression chambers (61, 62) are formed only in the first mechanism section (24), and the higher-stage compression chambers (63, 64) are formed only in the second mechanism section (25); and the intermediate back pressure chamber (85, 95) is also formed on the back side of the movable end plate section (51*a*, 52*a*) of the first mechanism section (24).

A seventh aspect of the invention is intended for the compressor of the first aspect of the invention, in which the compression mechanism (30) includes only a single pair of the fixed member (51, 52, 55, 56) and the movable member (51, 52, 55, 56), and both of the lower-stage compression chamber (61, 62) and the higher-stage compression chamber (63, 64) are formed between the fixed end plate section (51*a*, 52*a*, 55*a*, 56*a*) of the fixed member (51, 52, 55, 56) and the movable end plate section (51*a*, 52*a*, 55*a*, 56*a*) of the movable member (51, 52, 55, 56).

A eighth aspect of the invention is intended for the compressor of any one of the first to seventh aspect of the invention, in which carbon dioxide refrigerant is compressed by the compression mechanism (30).

A ninth aspect of the invention is intended for a refrigeration apparatus including a refrigerant circuit (10) which includes the compressor (20) of any one of the first to eighth aspects of the invention, and in which a refrigeration cycle is performed. The refrigerant circuit (10) includes an intermediate injection pipe (18) for injecting intermediate-pressure refrigerant into the higher-stage compression chambers (63, 64) of the compressor (20), and an opening/closing mechanism (16) for opening/closing the intermediate injection pipe (18).

Features

In the first aspect of the invention, the movable member (51, 52, 55, 56) including the intermediate back pressure chamber (85, 95) on the back side of the movable end plate section (51*a*, 52*a*, 55*a*, 56*a*) is pressed against the fixed member (51, 52, 55, 56) by the pressure of intermediate-pressure refrigerant in the intermediate back pressure chamber (85, 95). As described above, the pressure of intermediate-pressure refrigerant while the intermediate injection operation is stopped is lower than the pressure while the intermediate injection operation is performed. This allows the pressing force acting on the movable member (51, 52, 55, 56) while the intermediate injection operation is stopped to be smaller than the pressing force while the intermediate injection operation is performed, by forming the intermediate back pressure chamber (85, 95) on the back side. On the other hand, as described above, the separating force acting on the movable member (51, 52, 55, 56) while the intermediate injection operation is stopped is smaller than the separating force while the intermediate injection operation is performed. In the first aspect of the invention, while the intermediate injection operation is stopped, the separating force acting on the movable member (51, 52, 55, 56) and the pressing force acting on the movable member (51, 52, 55, 56) become smaller.

In the second aspect of the invention, the compression mechanism (30) includes the first mechanism section (24) and the second mechanism section (25). Both of the first mechanism section (24) and the second mechanism section (25) include the fixed members (51, 52, 55, 56) and the movable members (51, 52, 55, 56). The intermediate back pressure chambers (85, 95) are formed on the back sides of the movable end plate sections (51*a*, 52*a*, 55*a*, 56*a*) of at least one of the first mechanism section (24) and the second mechanism section (25). Thus, while the intermediate injection operation is stopped, the above-described separating force, and the pressing force acting on the movable member (51, 52, 55, 56) including the intermediate back pressure chamber (85, 95) on the back side of the movable end plate section (51*a*, 52*a*, 55*a*, 56*a*) become smaller.

In the third aspect of the invention, both of the lower-stage compression chamber (61, 62) and the higher-stage compression chamber (63, 64) are formed in each of the first mechanism section (24) and the second mechanism section (25). The intermediate back pressure chambers (85, 95) are formed on the back sides of the movable end plate section (51*a*, 52*a*, 55*a*, 56*a*) of both of the first mechanism section (24) and the second mechanism section (25).

In the fourth aspect of the invention, the intermediate back pressure chamber (85, 95) is formed on the back side of the movable end plate section (55*a*, 56*a*) of the second mechanism section (25) in which the higher-stage compression chambers (63, 64) are formed. When a state in which the intermediate injection operation is performed enters a state in which the intermediate injection operation is stopped, the pressure of intermediate-pressure refrigerant is decreased, thereby reducing the pressure on the discharge side of the lower-stage compression chamber (61, 62), and the pressure on the suction side of the higher-stage compression chamber (63, 64). The pressure is reduced by the same amount on the discharge side of the lower-stage compression chamber (61, 62) and the suction side of the higher-stage compression chamber (63, 64). In such a state, the higher-stage compression chamber (63, 64) is more susceptible to the change in pressure of intermediate-pressure refrigerant as compared to the lower-stage compression chamber (61, 62), and the rate of change in separating force by stopping the intermediate injection operation becomes greater. In the fourth aspect of the invention, the intermediate back pressure chamber (85, 95) is formed on the back side of the movable end plate section (55*a*, 56*a*) of the second mechanism section (25) having the greater rate of change in separating force by stopping the intermediate injection operation as compared to the rate in the first mechanism section (24).

In the fifth aspect of the invention, the intermediate back pressure chamber (85, 95) is formed on the back side of the movable end plate section (51*a*, 52*a*) of the first mechanism section (24) in which the lower-stage compression chambers (61, 62) are formed. The intermediate back pressure chamber (85, 95) is formed not only on the back side of the movable end plate section (55*a*, 56*a*) of the second mechanism section (25), but also on the back side of the movable end plate section (51*a*, 52*a*) of the first mechanism section (24). As described above, the compression ratio of refrigerant in the lower-stage compression chamber (61, 62) while the intermediate injection operation is stopped is smaller than the compression ratio while the intermediate injection operation is performed. Thus, in the first mechanism section (24), a workload required for refrigerant compression is decreased in response to the stoppage of the intermediate injection operation. In the fifth aspect of the invention, the intermediate back pressure chamber (85, 95) is formed on the back side of the movable end plate section (51*a*, 52*a*) of the first mechanism section (24) in which the workload required for refrigerant compression is decreased in response to the stoppage of the intermediate injection operation, resulting in the smaller pressing force acting on the movable member (51, 52, 55, 56) while the intermediate injection operation is stopped.

As in the fifth aspect of the invention, in the sixth aspect of the invention, the intermediate back pressure chamber (85, 95) is formed on the back side of the movable end plate section (51*a*, 52*a*) of the first mechanism section (24) in which the workload required for refrigerant compression is decreased in response to the stoppage of the intermediate injection operation, resulting in the smaller pressing force acting on the movable member (51, 52, 55, 56) while the intermediate injection operation is stopped.

In the seventh aspect of the invention, the compression mechanism (30) includes only the single pair of the fixed member (51, 52, 55, 56) and the movable member (51, 52, 55, 56). The intermediate back pressure chamber (85, 95) is formed on the back side of the movable end plate section (51*a*, 52*a*, 55*a*, 56*a*) of the movable member (51, 52, 55, 56) of the pair of the fixed member (51, 52, 55, 56) and the movable member (51, 52, 55, 56).

In the eighth aspect of the invention, the carbon dioxide refrigerant is compressed in the compression mechanism (30). The carbon dioxide refrigerant is compressed at two stages in the lower-stage compression chamber (61, 62) and the higher-stage compression chamber (63, 64).

In the ninth aspect of the invention, when the opening/closing mechanism (16) sets the intermediate injection pipe (18) to an open state, the intermediate injection operation is performed, in which intermediate-pressure refrigerant is injected into the higher-stage compression chamber (63, 64) of the compressor (20). On the other hand, when the opening/closing mechanism (16) sets the intermediate injection pipe (18) to a closed state, the intermediate injection operation is stopped. In the ninth aspect of the invention, as the compressor (20) of the refrigeration apparatus (1) performing the intermediate injection operation, the compressor (20) of any one of the first to eighth aspects of the invention, i.e., the compressor (20) in which the pressing force acting on the movable member (51, 52, 55, 56) becomes smaller while the intermediate injection operation is stopped is applied.

Advantages of the Invention

In the present invention, the intermediate back pressure chamber (85, 95) is formed on the back side of the movable end plate section (51*a*, 52*a*, 55*a*, 56*a*), resulting in the smaller separating force and the smaller pressing force acting on the movable member (51, 52, 55, 56) while the intermediate injection operation is stopped. Thus, in the conventional compressor in which the pressing force is obtained only by high-pressure fluid (refrigerant machine oil or high-pressure refrigerant) injected into the back side of the movable end plate section (51*a*, 52*a*, 55*a*, 56*a*), the pressing force is approximately constant before and after the intermediate injection operation is stopped. On the other hand, in the compressor (20) of the present invention, the pressing force becomes smaller while the intermediate injection operation is stopped, resulting in a smaller difference between the pressing force and the separating force while the intermediate injection operation is stopped. Thus, while the intermediate injection operation is stopped, friction force caused due to the difference between the pressing force and the separating force becomes smaller, thereby reducing an energy loss in the compression mechanism (30).

In the fourth aspect of the invention, the intermediate back pressure chamber (85, 95) is provided on the back side of the movable end plate section (51*a*, 52*a*, 55*a*, 56*a*) for the second mechanism section (25) having the greater rate of change in separating force by stopping the intermediate injection operation as compared to the rate in the first mechanism section (24). That is, the intermediate back pressure chamber (85, 95) is provided on the back side of the movable end plate section (55*a*, 56*a*) for the second mechanism section (25) in which, if the intermediate back pressure chamber (85, 95) is not formed on the back side of the movable end plate section (51*a*, 52*a*, 55*a*, 56*a*) as in the present invention, the energy loss due to the difference between the pressing force and the separating force increases while the intermediate injection operation is stopped as compared to the first mechanism section (24). Thus, an effect by forming the intermediate back pressure chamber (85, 95) in the second mechanism section (25) is greater than that in the first mechanism section (24), thereby effectively reducing the energy loss in the compression mechanism (30).

In the fifth aspect of the invention, the intermediate back pressure chamber (85, 95) is provided not only on the back side of the movable end plate section (55*a*, 56*a*) of the second mechanism section (25), but also on the back side of the movable end plate section (51*a*, 52*a*) of the first mechanism section (24). Thus, the energy loss while the intermediate injection operation is stopped can be reduced not only in the second mechanism section (25) but also in the first mechanism section (24), thereby reducing the energy loss in the compression mechanism (30).

In each of the fifth and sixth aspects of the invention, the intermediate back pressure chamber (85, 95) is provided on the back side of the movable end plate section (51*a*, 52*a*) of the first mechanism section (24) in which the workload required for refrigerant compression is decreased in response to the stoppage of the intermediate injection operation, resulting in the smaller pressing force acting on the movable member (51, 52, 55, 56) while the intermediate injection operation is stopped. In the conventional compressor in which the pressing force is obtained only by high-pressure fluid (refrigerant machine oil or high-pressure refrigerant) injected into the back side of the movable end plate section, the workload required for refrigeration compression is decreased in response to the stoppage of the intermediate injection operation in the mechanism section including the lower-stage compression chambers, but the friction force caused between the movable member and the fixed member increases. This significantly degrades compression efficiency in the mechanism section in which the lower-stage compression chambers are formed, while the intermediate injection operation is stopped. On the other hand, in each of the fifth and sixth aspects of the invention, the pressing force acting on the movable member (51, 52, 55, 56) of the first mechanism section (24) becomes smaller while the intermediate injection operation is stopped. Thus, the friction force caused due to the difference between the pressing force and the separating force becomes smaller than that of the conventional compressor, thereby reducing the degradation of the compression efficiency while the intermediate injection operation is stopped.

In the ninth aspect of the invention, as the compressor (20) of the refrigeration apparatus (1) performing the intermediate injection operation, the compressor (20) is applied, in which the pressing force acting on the movable member (51, 52, 55, 56) becomes smaller while the intermediate injection operation is stopped. This reduces the energy loss in the compressor (20) while the intermediate injection operation is stopped, thereby improving operational efficiency of the refrigeration apparatus (1).

DESCRIPTION OF EMBODIMENTS

Embodiments of the present invention will be described in detail hereinafter with reference to the drawings.

First Embodiment

A refrigeration apparatus of a first embodiment of the present invention is an air conditioner (1) for switching between heating and cooling of a room. The air conditioner (1) includes a refrigerant circuit (10) in which a refrigeration cycle is performed by circulating refrigerant, and serves as a so-called "heat pump" air conditioner. The refrigerant circuit (10) is filled with carbon dioxide as refrigerant.

Figure 1:
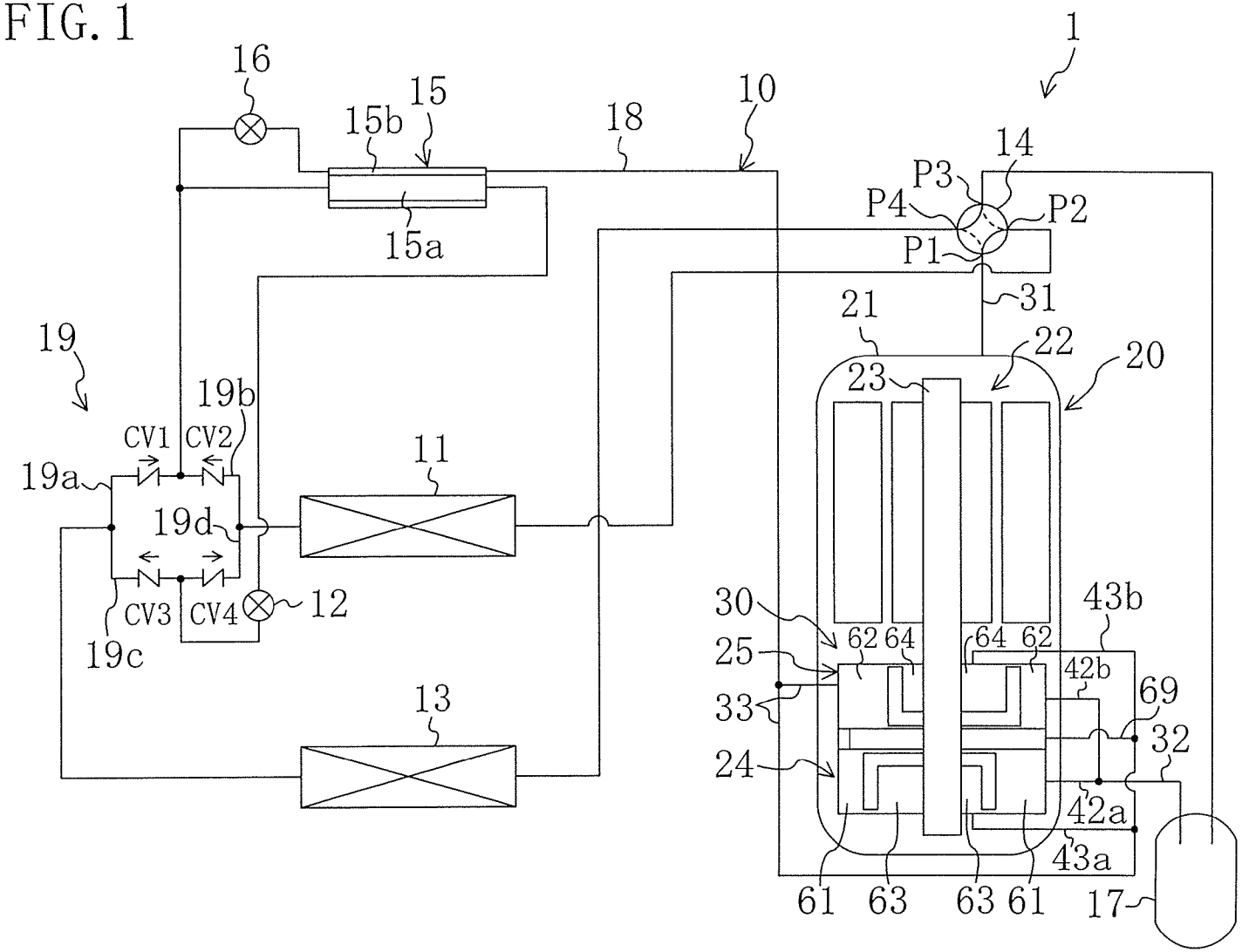
FIG. 1 is a piping system diagram of a refrigerant circuit of an air conditioner of a first embodiment.

As illustrated in FIG. 1, as main components, the refrigerant circuit (10) includes a compressor (20); an indoor heat exchanger (11); an expansion valve (12); and an outdoor heat exchanger (13).

The indoor heat exchanger (11) is provided in an indoor unit. In the indoor heat exchanger (11), heat is exchanged between room air sent by an indoor fan (not shown in the figure) and refrigerant. On the other hand, the outdoor heat exchanger (13) is provided in an outdoor unit. In the outdoor heat exchanger (13), heat is exchanged between outdoor air sent by an outdoor fan (not shown in the figure) and refrigerant. In addition, the expansion valve (12) is provided between an internal heat exchanger (15) which will be described later and a second end of a bridge circuit (19) which will be described later. The expansion valve (12) is an electronic expansion valve with adjustable opening.

In addition, the refrigerant circuit (10) includes a four-way switching valve (14); the bridge circuit (19); the internal heat exchanger (15); a pressure reducing valve (16); and a receiver (17).

The four-way switching valve (14) includes four first to fourth ports. The first port of the four-way switching valve (14) is connected to a discharge pipe (31) of the compressor (20); the second port is connected to the indoor heat exchanger (11); the third port is connected to a suction pipe (32) of the compressor (20) through the receiver (17); and the fourth port is connected to the outdoor heat exchanger (13). The four-way switching valve (14) is switchable between a first state (state indicated by a solid line in FIG. 1) in which the first port (P1) communicates with the second port (P2) with the third port (P3) communicating with the fourth port (P4), and a second state (state indicated by a dashed line in FIG. 1) in which the first port (P1) communicates with the fourth port (P4) with the second port (P2) communicating with the third port (P3).

The bridge circuit (19) is a circuit in which a first connection line (19*a*), a second connection line (19*b*), a third connection line (19*c*), and a fourth connection line (19*d*) are connected to each other in a bridge form. The first connection line (19*a*) connects between the outdoor heat exchanger (13) and one of ends of the internal heat exchanger (15). The second connection line (19*b*) connects between the indoor heat exchanger (11) and the one of ends of the internal heat exchanger (15). The third connection line (19*c*) connects between the outdoor heat exchanger (13) and the other end of the internal heat exchanger (15). The fourth connection line (19*d*) connects between the indoor heat exchanger (11) and the other end of the internal heat exchanger (15).

A first check valve (CV1) for stopping refrigerant from flowing from the one of ends of the internal heat exchanger (15) toward the outdoor heat exchanger (13) is provided in the first connection line (19*a*). A second check valve (CV2) for stopping refrigerant from flowing from the one of ends of the internal heat exchanger (15) toward the indoor heat exchanger (11) is provided in the second connection line (19*b*). A third check valve (CV3) for stopping refrigerant from flowing from the outdoor heat exchanger (13) toward the other end of the internal heat exchanger (15) is provided in the third connection line (19*c*). A fourth check valve (CV4) for stopping refrigerant from flowing from the indoor heat exchanger (11) toward the other end of the internal heat exchanger (15) is provided in the fourth connection line (19*d*).

The internal heat exchanger (15) serves as a double-pipe heat exchanger including a first heat exchange path (15*a*) and a second heat exchange path (15*b*). The first heat exchange path (15*a*) is arranged so as to communicate with a refrigerant pipe connecting between a first end of the bridge circuit (19), to which outlet ends of the first connection line (19*a*) and of the second connection line (19*b*) are connected; and a second end of the bridge circuit (19), to which inlet ends of the third connection line (19*c*) and of the fourth connection line (19*d*) are connected. The second heat exchange path (15*b*) is arranged so as to communicate with an intermediate injection pipe (18) branching between the internal heat exchanger (15) and the first end of the bridge circuit (19). The intermediate injection pipe (18) serves as an intermediate injection path, and is connected to an intermediate-pressure access pipe (33) which will be described later. The pressure reducing valve (16) serving as an opening/closing mechanism is provided on an upstream side of the internal heat exchanger (15) in the intermediate injection pipe (18). In the internal heat exchanger (15), heat can be exchanged between high-pressure liquid refrigerant flowing in the first heat exchange path (15*a*) and intermediate-pressure refrigerant flowing in the second heat exchange path (15*b*).

In the first embodiment, the compressor (20) serves as a compressor for carbon dioxide refrigerant. The compressor (20) includes a compression mechanism (30) with a first mechanism section (24) and a second mechanism section (25). A compression chamber (61, 62) at the lower stage and a compression chamber (63, 64) at the higher stage are formed in each of the mechanism sections (24, 25). The compressor (20) will be described in detail later.

A plurality of pipes are connected to the compressor (20). Specifically, a first branched suction pipe (42*a*) branched from the suction pipe (32) is connected to a suction side of the lower-stage compression chamber (61) of the first mechanism section (24). A second branched suction pipe (42*b*) branched from the suction pipe (32) is connected to a suction side of the lower-stage compression chamber (62) of the second mechanism section (25). The intermediate-pressure access pipe (33) is connected to a discharge side of the lower-stage compression chamber (61) of the second mechanism section (25). A discharge side of the lower-stage compression chamber (62) of the second mechanism section (25) communicates with the discharge side of the lower-stage compression chamber (61) of the first mechanism section (24) inside the compressor (20). In addition, a first branched intermediate pipe (43*a*) branched from the intermediate-pressure access pipe (33) is connected to a suction side of the higher-stage compression chamber (63) of the first mechanism section (24). A second branched intermediate pipe (43*b*) branched from the intermediate-pressure access pipe (33) is connected to a suction side of the higher-stage compression chamber (64) of the second mechanism section (25). A connecting pipe (69) connected to an intermediate connection path (79) which will be described later is branched from the second branched intermediate pipe (43*b*).

<Configuration of Compressor>

In the compressor (20) of the first embodiment, the first mechanism section (24) and the second mechanism section (25) employ a fixed piston system in which, among cylinders (52, 56) and pistons (53, 57), the cylinders (52, 56) eccentrically rotate. The same fixed piston system is also employed in a second embodiment which will be described later.

Figure 2:
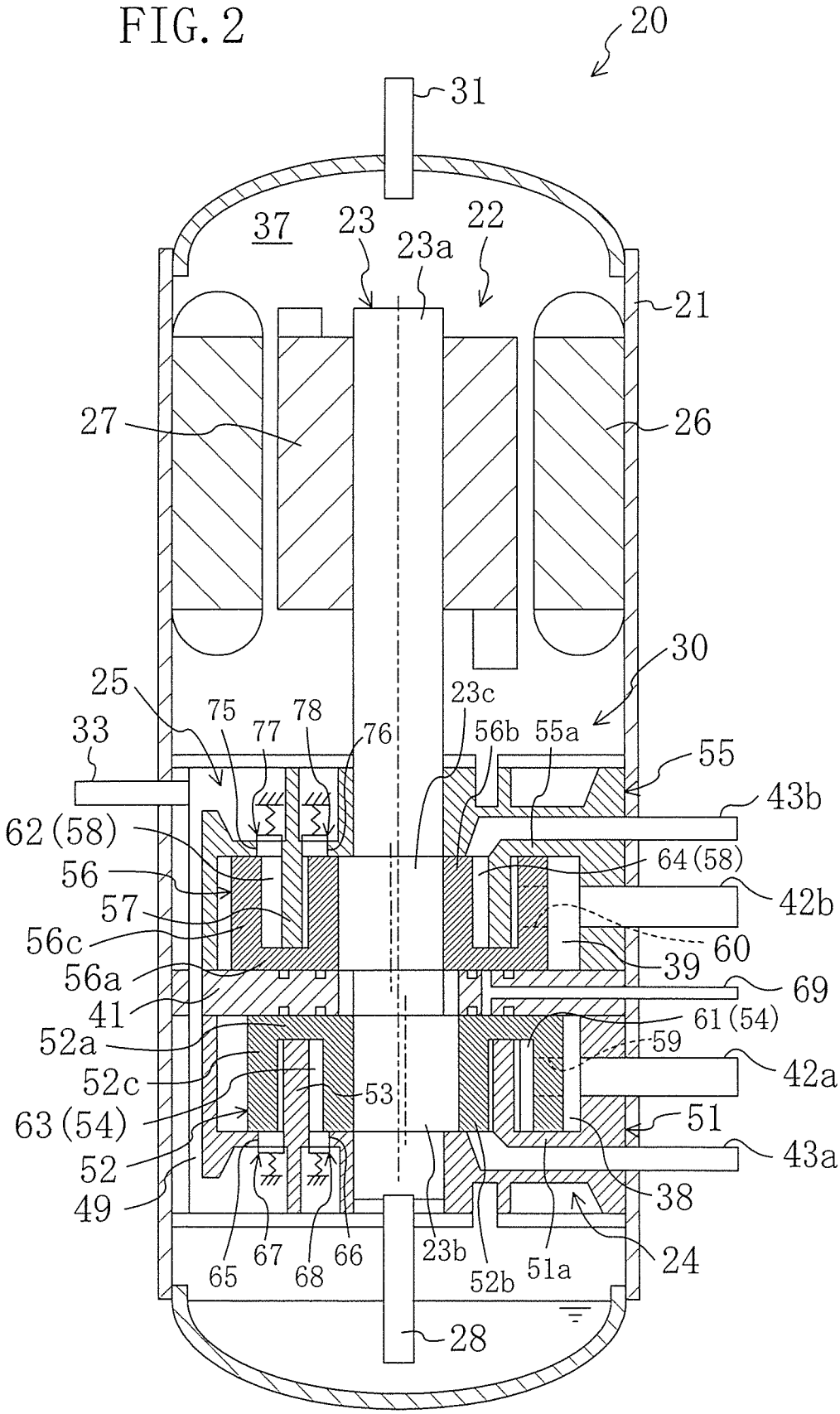
FIG. 2 is a longitudinal sectional view of a compressor of the first embodiment.

As illustrated in FIG. 2, the compressor (20) includes an elongated hermetic casing (21). An electrical motor (22) and the compression mechanism (30) are accommodated inside the casing (21). The compressor (20) serves as a so-called "high-pressure dome type" compressor in which the casing (21) is filled with high-pressure refrigerant.

The electrical motor (22) includes a stator (26) and a rotor (27). The stator (26) is fixed to a body section of the casing (21). On the other hand, the rotor (27) is arranged on an inner side with respect to the stator (26), and is connected to a main shaft section (23*a*) of a drive shaft (23). The rotational speed of the electrical motor (22) is variable by an inverter control. That is, the electrical motor (22) serves as an inverter-type compressor with variable capacity.

The drive shaft (23) includes a first eccentric section (23*b*) positioned closer to a lower section thereof; and a second eccentric section (23*c*) positioned closer to a central section thereof. Each of the first eccentric section (23*b*) and the second eccentric section (23*c*) is eccentric to a shaft center of the main shaft section (23*a*) of the drive shaft (23). In addition, the first eccentric section (23*b*) and the second eccentric section (23*c*) are 180° out of phase with each other about the shaft center of the drive shaft (23).

The compression mechanism (30) is arranged below the electrical motor (22). The compression mechanism (30) includes the first mechanism section (24) closer to a bottom section of the casing (21); and the second mechanism section (25) closer to the electrical motor (22) side.

The first mechanism section (24) includes a first housing (51) fixed to the casing (21); and a first cylinder (52) accommodated in the first housing (51). The first housing (51) serves as a fixed member, and the first cylinder (52) serves as a movable member.

The first housing (51) includes a discoid fixed end plate section (51*a*); and a circular first piston (53) upwardly protruding from an upper surface of the fixed end plate section (51*a*). On the other hand, the first cylinder (52) includes a discoid movable end plate section (52*a*); a circular inner cylinder section (52*b*) downwardly protruding from an inner circumferential end of the movable end plate section (52*a*); and a circular outer cylinder section (52*c*) downwardly protruding from an outer circumferential end of the movable end plate section (52*a*). The first eccentric section (23*b*) is fitted in the inner cylinder section (52*b*) of the first cylinder (52). The first cylinder (52) eccentrically rotates about the shaft center of the main shaft section (23*a*) in response to rotation of the drive shaft (23).

In the first cylinder (52), a circular first cylinder chamber (54) is formed between an outer circumferential surface of the inner cylinder section (52*b*) and an inner circumferential surface of the outer cylinder section (52*c*). The first piston (53) is arranged in the first cylinder chamber (54). Consequently, the first cylinder chamber (54) is divided into the first lower-stage compression chamber (61) formed between an outer circumferential surface of the first piston (53) and an outer wall of the first cylinder chamber (54), and the first higher-stage compression chamber (63) formed between an inner circumferential surface of the first piston (53) and an inner wall of the first cylinder chamber (54). In addition, in the outer cylinder section (52*c*) of the first cylinder (52), a first communication path (59) allowing communication between a suction space (38) outside the first cylinder (52) and the first lower-stage compression chamber (61) is formed.

Figure 3:
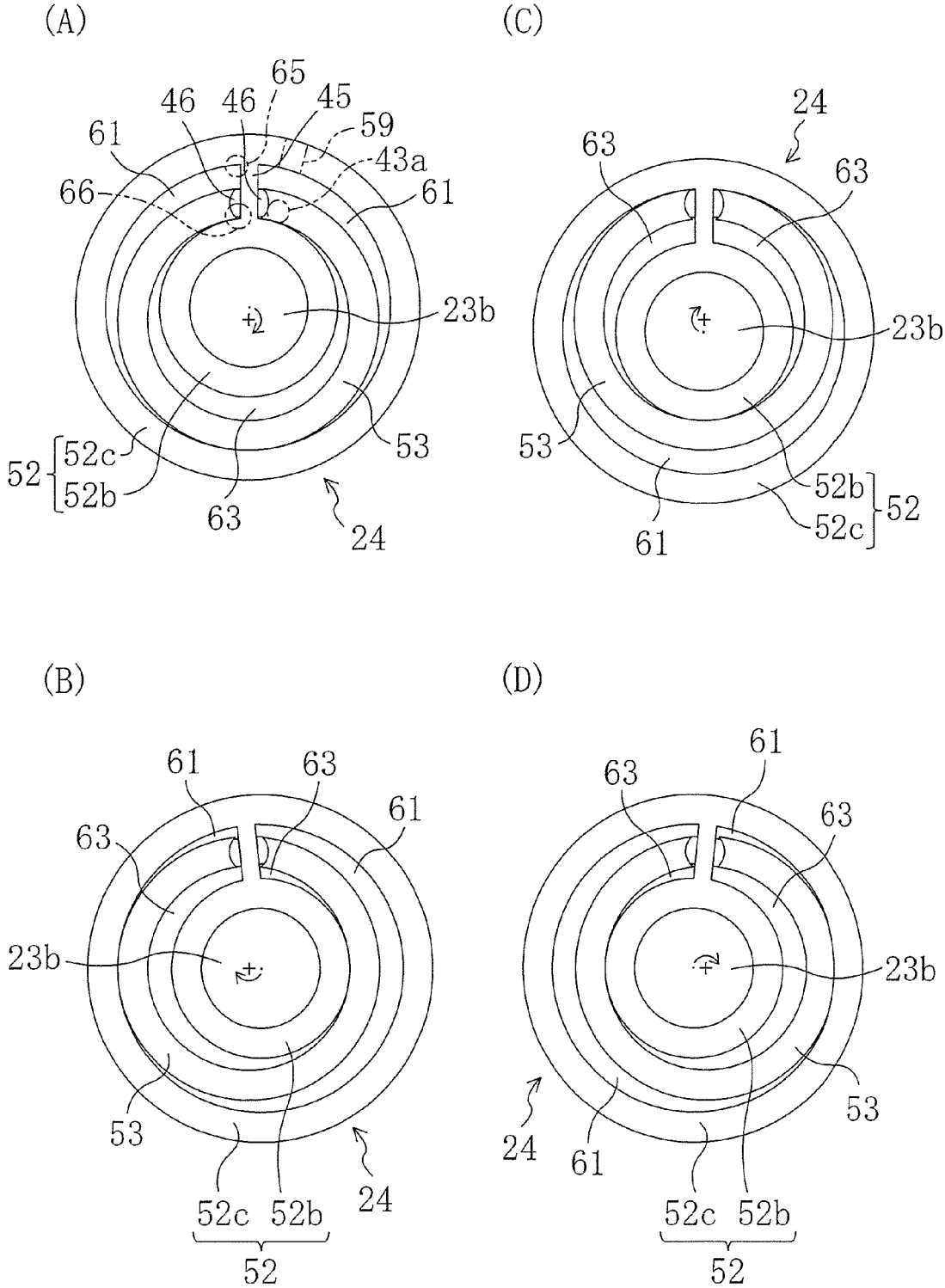
FIG. 3 are cross-sectional views of a first mechanism section (second mechanism section) of the first embodiment.

As illustrated in FIG. 3, a blade (45) extending from the inner circumferential surface of the outer cylinder section (52*c*) to the outer circumferential surface of the inner cylinder section (52*b*) is provided in the first cylinder (52). The blade (45) divides the first lower-stage compression chamber (61) and the first higher-stage compression chamber (63) into low-pressure chambers to be the suction side and high-pressure chambers to be the discharge side. On the other hand, the first piston (53) is formed in a C-shape, i.e., a part of the annular ring splits, and the blade (45) is inserted into such a split portion. Semicircular bushes (46) are fitted in the split portion of the first piston (53) so as to sandwich the blade (45). The bushes (46) can swing at ends of the first piston (53). The foregoing configuration allows the first cylinder (52) to move back and forth in the extending direction of the blade (45), and to swing together with the bushes (46). When rotating the drive shaft (23), the first cylinder (52) eccentrically rotates in the order illustrated in FIGS. 3(A)-3(D), thereby compressing refrigerant in the first lower-stage compression chamber (61) and the first higher-stage compression chamber (63).

The second mechanism section (25) includes the same machine elements as those of the first mechanism section (24). The second mechanism section (25) is vertically flipped with respect to the first mechanism section (24) with a middle plate (41) being interposed therebetween.

Specifically, the second mechanism section (25) includes a second housing (55) fixed to the casing (21); and a second cylinder (56) accommodated in the second housing (55). The second housing (55) serves as the fixed member, and the second cylinder (56) serves as the movable member.

The second housing (55) includes a discoid fixed end plate section (55*a*); and a circular second piston (57) downwardly protruding from a lower surface of the fixed end plate section (55*a*). On the other hand, the second cylinder (56) includes a discoid end plate section (56*a*); a circular inner cylinder section (56*b*) upwardly protruding from an inner circumferential end of the end plate section (56*a*); and a circular outer cylinder section (56*c*) upwardly protruding from an outer circumferential end of the end plate section (56*a*). The second eccentric section (23*c*) is fitted into the inner cylinder section (56*b*) of the second cylinder (56). The second cylinder (56) eccentrically rotates about the shaft center of the main shaft section (23*a*) in response to the rotation of the drive shaft (23).

In the second cylinder (56), a circular second cylinder chamber (58) is formed between an outer circumferential surface of the inner cylinder section (56*b*) and an inner circumferential surface of the outer cylinder section (56*c*). The second piston (57) is arranged in the second cylinder chamber (58). Consequently, the second cylinder chamber (58) is divided into the second lower-stage compression chamber (62) formed between an outer circumferential surface of the second piston (57) and an outer wall of the second cylinder chamber (58); and the second higher-stage compression chamber (64) formed between an inner circumferential surface of the second piston (57) and an inner wall of the second cylinder chamber (58). In addition, in the outer cylinder section (56*c*) of the second cylinder (56), a second communication path (60) allowing communication between a suction space (39) outside the second cylinder (56) and the second lower-stage compression chamber (62) is formed.

In the second mechanism section (25), when rotating the drive shaft (23), the second cylinder (56) eccentrically rotates as in the first mechanism section (24). Consequently, refrigerant is compressed in the second lower-stage compression chamber (62) and the second higher-stage compression chamber (64).

Each of the first mechanism section (24) and the second mechanism section (25) is designed so that the suction volume ratio of the higher-stage compression chamber (63, 64) to the lower-stage compression chamber (61, 62) is a value within a range of 0.8-1.3 (e.g., 1.0). The discharge pipe (31), the first branched suction pipe (42*a*), the second branched suction pipe (42*b*), the intermediate-pressure access pipe (33), the first branched intermediate pipe (43*a*), and the second branched intermediate pipe (43*b*) penetrate the casing (21). The discharge pipe (31) penetrates a top section of the casing (21), and the other pipes (42, 43) penetrate the body section of the casing (21). The discharge pipe (31) opens to an internal space (37) which becomes a high-pressure space when operating the compressor (20).

The first branched suction pipe (42*a*) and the first branched intermediate pipe (43*a*) are connected to the first mechanism section (24). The first branched suction pipe (42*a*) is connected to the suction side of the first lower-stage compression chamber (61) through the first communication path (59). The discharge side of the first lower-stage compression chamber (61) is connected to the discharge side of the second lower-stage compression chamber (62) through an access path (49) formed through the first housing (51), the middle plate (41), and the second housing (55). In addition, the first branched intermediate pipe (43*a*) is connected to the suction side of the first higher-stage compression chamber (63). The discharge side of the first higher-stage compression chamber (63) is connected to the internal space (37) through an access path which is not shown in the figure.

In the first mechanism section (24), an outer discharge port (65) and an inner discharge port (66) are formed in the first housing (51). The outer discharge port (65) allows the discharge side of the first lower-stage compression chamber (61) to communicate with the access path (49). A first discharge valve (67) is provided in the outer discharge port (65). The first discharge valve (67) opens the outer discharge port (65) when refrigerant pressure on the discharge side of the first lower-stage compression chamber (61) is equal to or greater than refrigerant pressure on the access path (49) side. On the other hand, the inner discharge port (66) allows the discharge side of the first higher-stage compression chamber (63) to communicate with the internal space (37). A second discharge valve (68) is provided in the inner discharge port (66). The second discharge valve (68) opens the inner discharge port (66) when refrigerant pressure on the discharge side of the first higher-stage compression chamber (63) is equal to or greater than refrigerant pressure in the internal space (37) of the casing (21).

The second branched suction pipe (42*b*), the intermediate-pressure access pipe (33), and the second branched intermediate pipe (43*b*) are connected to the second mechanism section (25). The second branched suction pipe (42*b*) is connected to the suction side of the second lower-stage compression chamber (62) through the second communication path (60). The intermediate-pressure access pipe (33) is connected to the discharge side of the second lower-stage compression chamber (62). In addition, the second branched intermediate pipe (43*b*) is connected to the suction side of the second higher-stage compression chamber (64). The discharge side of the second higher-stage compression chamber (64) is connected to the internal space (37) through an access path which is not shown in the figure.

As in the first mechanism section (24), an outer discharge port (75) and an inner discharge port (76) are formed in the second housing (55) of the second mechanism section (25). The outer discharge port (75) allows the discharge side of the second lower-stage compression chamber (62) to communicate with the intermediate-pressure access pipe (33). A third discharge valve (77) is provided in the outer discharge port (75). The third discharge valve (77) opens the outer discharge port (75) when refrigerant pressure on the discharge side of the second lower-stage compression chamber (62) is equal to or greater than refrigerant pressure on the intermediate-pressure access pipe (33) side. On the other hand, the inner discharge port (76) allows the discharge side of the second higher-stage compression chamber (64) to communicate with the internal space (37) of the casing (21). A fourth discharge valve (78) is provided in the inner discharge port (76). The fourth discharge valve (78) opens the inner discharge port (76) when refrigerant pressure on the discharge side of the second higher-stage compression chamber (64) is equal to or greater than the refrigerant pressure in the internal space (37) of the casing (21).

An oil sump in which refrigerant machine oil is stored is formed in the bottom section of the casing (21). An oil pump (28) dipped in the oil sump is provided at a lower end of the drive shaft (23). An oil supply path (not shown in the figure) through which refrigerant machine oil drawn by the oil pump (28) circulates is formed inside the drive shaft (23). In the compressor (20), the refrigerant machine oil drawn by the oil pump (28) is supplied to a sliding section of each of the mechanism sections (24, 25) and a bearing section of the drive shaft (23) through the oil supply path in response to the rotation of the drive shaft (23).

Figure 4:
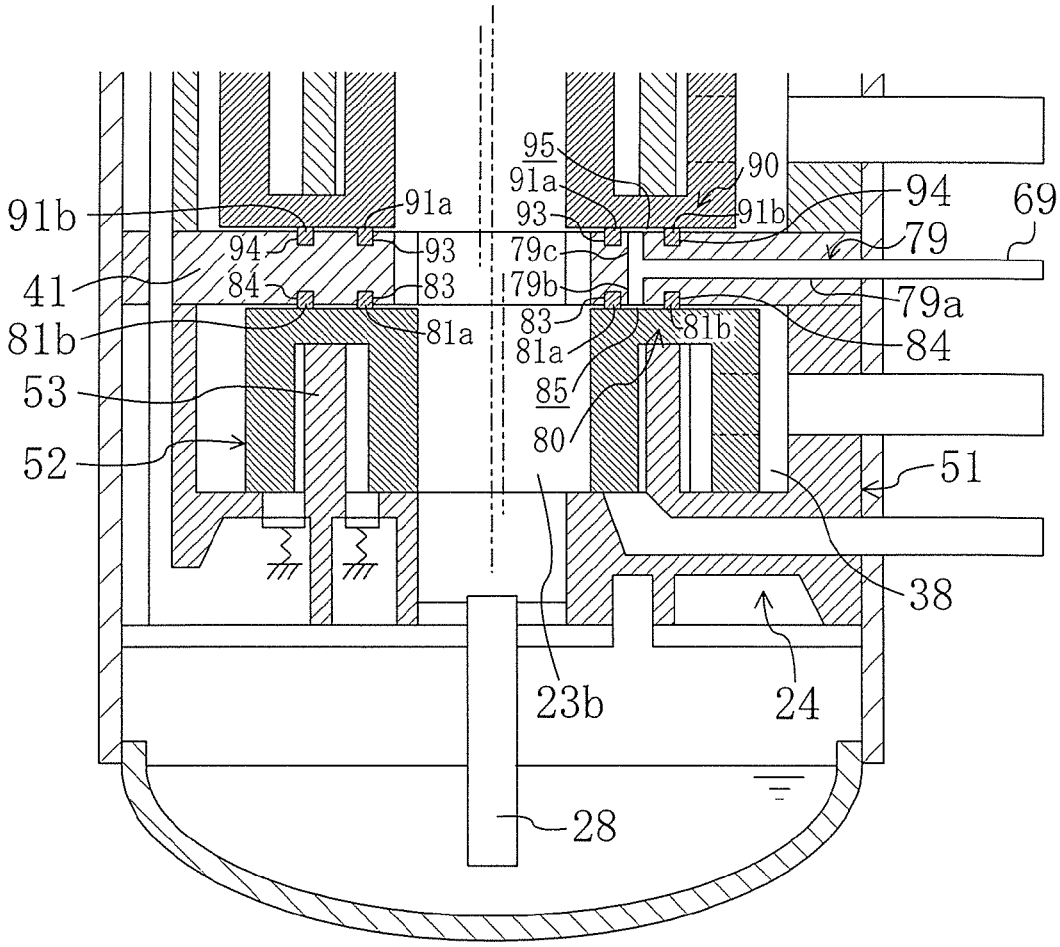
FIG. 4 is an enlarged sectional view of a press mechanism of the first embodiment (second embodiment).

In the present embodiment, as illustrated in FIG. 4, press mechanisms (80, 90) are provided in the middle plate (41). The press mechanisms (80, 90) include a first press section (80) provided for the first mechanism section (24), and a second press section (90) provided for the second mechanism section (25).

The first press section (80) presses the first cylinder (52) against the first housing (51). The first press section (80) includes a first inner seal ring (81*a*) and a first outer seal ring (81*b*) defining a first intermediate back pressure chamber (85); and the intermediate connection path (79) formed inside the middle plate (41). The first inner seal ring (81*a*) and the first outer seal ring (81*b*) serve as dividing members.

The first inner seal ring (81*a*) is fitted into a first inner circular groove (83) formed in a lower surface of the middle plate (41) so as to surround a through-hole of the middle plate (41), into which the drive shaft (23) is inserted. On the other hand, the first outer seal ring (81*b*) is fitted into a first outer circular groove (84) formed in the lower surface of the middle plate (41) so as to surround the first inner circular groove (83). The first inner circular groove (83) and the first outer circular groove (84) are concentrically arranged. The first intermediate back pressure chamber (85) is defined by the lower surface of the middle plate (41), an upper surface of the first cylinder (52), an outer circumferential surface of the first inner circular groove (83), and an inner circumferential surface of the first outer circular groove (84).

An end of the intermediate connection path (79) opens at an outer circumferential surface of the middle plate (41), and the intermediate connection path (79) is connected to the connecting pipe (69) at such an end. The intermediate connection path (79) includes a main path (79*a*) inwardly extending from the outer circumferential surface of the middle plate (41); a first branched path (79*b*) branched toward a lower side at an inner end of the main path (79*a*); and a second branched path (79*c*) branched toward an upper side at the inner end of the main path (79*a*). The first branched path (79*b*) opens to the first intermediate back pressure chamber (85) in the lower surface of the middle plate (41). The second branched path (79*c*) opens to a second intermediate back pressure chamber (95) which will be described later, in an upper surface of the middle plate (41).

The first intermediate back pressure chamber (85) communicates with the connecting pipe (69) through the first branched path (79*b*) and the main path (79*a*). Thus, intermediate-pressure refrigerant flowing toward the second higher-stage compression chamber (64) is injected into the first intermediate back pressure chamber (85). In addition, high-pressure refrigerant machine oil from the drive shaft (23) side is injected into a portion inside the first inner seal ring (81*a*). A portion outside the first outer seal ring (81*b*) communicates with the suction space (38). The first press section (80) presses the first cylinder (52) against the first housing (51) by high-pressure refrigerant machine oil inside the first inner seal ring (81*a*), intermediate-pressure refrigerant in the first intermediate back pressure chamber (85), and low-pressure refrigerant outside the first outer seal ring (81*b*).

In addition, the second press section (90) presses the second cylinder (56) against the second housing (55). The second press section (90) includes a second inner seal ring (91*a*) and a second outer seal ring (91*b*) defining the second intermediate back pressure chamber (95); and the intermediate connection path (79). The second inner seal ring (91*a*) and the second outer seal ring (91*b*) serve as the dividing members. In the press mechanisms (80, 90), the first press section (80) and the second press section (90) share the main path (79*a*) of the intermediate connection path (79).

The second inner seal ring (91*a*) is fitted into a second inner circular groove (93) formed in the upper surface of the middle plate (41) so as to surround the through-hole of the middle plate (41). On the other hand, the second outer seal ring (91*b*) is fitted into a second outer circular groove (94) formed in the upper surface of the middle plate (41) so as to surround the second inner circular groove (93). The second inner circular groove (93) and the second outer circular groove (94) are concentrically arranged. The second intermediate back pressure chamber (95) is defined by the upper surface of the middle plate (41), a lower surface of the second cylinder (56), an outer circumferential surface of the second inner circular groove (93), and an inner circumferential surface of the second outer circular groove (94).

The second intermediate back pressure chamber (95) communicates with the connecting pipe (69) through the second branched path (79*c*) and the main path (79*a*). Thus, intermediate-pressure refrigerant flowing toward the second higher-stage compression chamber (64) is injected into the second intermediate back pressure chamber (95). In addition, high-pressure refrigerant machine oil from the drive shaft (23) side is injected a portion inside the second inner seal ring (91*a*). A portion outside the second outer seal ring (91*b*) communicates with the suction space (39). The second press section (90) presses the second cylinder (56) against the second housing (55) by high-pressure refrigerant machine oil inside the second inner seal ring (91*a*), intermediate-pressure refrigerant in the second intermediate back pressure chamber (95), and low-pressure refrigerant outside the second outer seal ring (91*b*).

In the compressor (20) of the present embodiment, the foregoing configuration allows the cylinder (52, 56) of the mechanism section (24, 25) to eccentrically rotate relative to the piston (53, 57) in response to the rotation of the drive shaft (23). Consequently, the volume of the compression chamber (61-64) of the mechanism section (24, 25) is periodically changed, thereby compressing refrigerant in the compression chamber (61-64) of the mechanism section (24, 25).

Operation

Next, an operation of the air conditioner (1) of the first embodiment will be described. The air conditioner (1) can switch among a heating operation, a cooling operation, etc. which will be described below.

(Heating Operation)

In the heating operation of the air conditioner (1), the four-way switching valve (14) is set to the first state while adjusting the opening of the expansion valve (12) as necessary. In such a state, when operating the compressor (20), a refrigeration cycle in which the indoor heat exchanger (11) serves as a radiator, and the outdoor heat exchanger (13) serves as an evaporator is performed in the refrigerant circuit (10). In the air conditioner (1), a supercritical refrigeration cycle is performed, in which the high-level pressure of the refrigeration cycle is higher than the critical pressure of carbon dioxide refrigerant. The same supercritical refrigeration cycle is also performed in the cooling operation.

In the air conditioner (1), if required heating capacity is relatively large, the pressure reducing valve (16) is set to an open state. When the pressure reducing valve (16) is set to the open state, the intermediate injection operation is performed, in which intermediate-pressure refrigerant of the refrigeration cycle is injected into the higher-stage compression chamber (63, 64) of the mechanism section (24, 25) of the compressor (20) through the intermediate injection pipe (18). The opening of the pressure reducing valve (16) is adjust as necessary while performing the intermediate injection operation. On the other hand, if the required heating capacity is relatively low, the pressure reducing valve (16) is set to a closed state, and then the intermediate injection operation is stopped.

First, a flow of refrigerant while the intermediate injection operation is stopped will be described. High-pressure refrigerant discharged from the discharge pipe (31) of the compressor (20) flows into the indoor heat exchanger (11) through the four-way switching valve (14). In the indoor heat exchanger (11), the refrigerant releases heat to room air. Consequently, a room is heated.

The refrigerant cooled in the indoor heat exchanger (11) flows in the first heat exchange path (15*a*) of the internal heat exchanger (15), and then the pressure of such refrigerant is reduced to a lower level by the expansion valve (12). Subsequently, the refrigerant flows into the outdoor heat exchanger (13). In the outdoor heat exchanger (13), the refrigerant is evaporated by absorbing heat from outdoor air. The refrigerant evaporated in the outdoor heat exchanger (13) is sent to a suction side of the compressor (20) through the receiver (17).

The refrigerant flowing into the suction side of the compressor (20) branches into the first branched suction pipe (42*a*) and the second branched suction pipe (42*b*). The refrigerant flowing into the first branched suction pipe (42*a*) is compressed in the first lower-stage compression chamber (61) of the first mechanism section (24). The refrigerant flowing into the second branched suction pipe (42*b*) is compressed in the second lower-stage compression chamber (62) of the second mechanism section (25). The refrigerant compressed in one of the lower-stage compression chambers (61, 62) joins the refrigerant compressed in the other lower-stage compression chamber (61, 62), and then such refrigerant circulates in the intermediate-pressure access pipe (33). Subsequently, the refrigerant branches into the first branched intermediate pipe (43*a*) and the second branched intermediate pipe (43*b*). The refrigerant flowing into the first branched intermediate pipe (43*a*) is compressed in the first higher-stage compression chamber (63) of the first mechanism section (24). The refrigerant flowing into the second branched intermediate pipe (43*b*) is compressed in the second higher-stage compression chamber (64) of the second mechanism section (25). The refrigerant compressed in the higher-stage compression chambers (63, 64) flows into the internal space (37) of the casing (21), and then is discharged through the discharge pipe (31).

Next, a flow of refrigerant while the intermediate injection operation is performed will be described. Differences from the state while the intermediate injection operation is stopped will be described below. While the intermediate injection operation is performed, the pressure of a part of refrigerant cooled in the indoor heat exchanger (11) is reduced to an intermediate level pressure by the pressure reducing valve (16), and then such refrigerant flows into the second heat exchange path (15*b*). Thus, in the internal heat exchanger (15), high-pressure refrigerant circulates in the first heat exchange path (15*a*), whereas intermediate-pressure refrigerant circulates in the second heat exchange path (15*b*). In the internal heat exchanger (15), heat of refrigerant on the first heat exchange path (15*a*) side is imparted to refrigerant on the second heat exchange path (15*b*) side, thereby evaporating the refrigerant on the second heat exchange path (15*b*) side. The refrigerant evaporated in the second heat exchange path (15*b*) joins refrigerant compressed in the lower-stage compression chambers (61, 62), and then is compressed in the higher-stage compression chambers (63, 64).

In the present embodiment, the press section (80, 90) provided for the mechanism section (24, 25) includes the seal rings (81, 91) forming the intermediate back pressure chamber (85, 95) on a back side of the end plate section (51*a*, 52*a*, 55*a*, 56*a*). The cylinder (52, 56) of the mechanism section (24, 25) is pressed against the housing (51, 55) by the pressure of intermediate-pressure refrigerant in the intermediate back pressure chamber (85, 95). As described above, the pressure of intermediate-pressure refrigerant while the intermediate injection operation is stopped is lower than the pressure while the intermediate injection operation is performed. Thus, the pressing force of the press sections (80, 90) while the intermediate injection operation is stopped is smaller than the pressing force while the intermediate injection operation is performed. On the other hand, as described above, the separating force acting on the cylinders (52, 56) while the intermediate injection operation is stopped is smaller than the separating force while the intermediate injection operation is performed. In the present embodiment, the seal ring (81, 91) is provided on the back side of the end plate section (51*a*, 52*a*, 55*a*, 56*a*) of the mechanism section (24, 25), resulting in the smaller separating force acting on the member (51, 52, 55, 56) and the smaller pressing force of the press sections (80, 90) while the intermediate injection operation is stopped.

(Cooling Operation)

In the cooling operation of the air conditioner (1), the four-way switching valve (14) is set to the second state, and the opening of the expansion valve (12) is adjusted as necessary. In such a state, when operating the compressor (20), a refrigeration cycle in which the outdoor heat exchanger (13) serves as the radiator, and the indoor heat exchanger (11) serves as the evaporator is performed in the refrigerant circuit (10). As in the heating operation, the intermediate injection operation can be also performed in the cooling operation. Only a state while the intermediate injection operation is stopped will be described below.

Specifically, high-pressure refrigerant discharged through the discharge pipe (31) of the compressor (20) flows into the outdoor heat exchanger (13) through the four-way switching valve (14). In the outdoor heat exchanger (13), heat is released from the refrigerant to outdoor air. The pressure of the refrigerant cooled in the outdoor heat exchanger (13) is reduced to the lower level by the expansion valve (12), and then such refrigerant flows into the indoor heat exchanger (11). In the indoor heat exchanger (11), the refrigerant is evaporated by absorbing heat from room air. Consequently, the room is cooled. The refrigerant evaporated in the indoor heat exchanger (11) is sent to the suction side of the compressor (20) through the receiver (17).

As in the cooling operation, refrigerant is compressed at two stages in the first mechanism section (24) and the second mechanism section (25) of the compressor (20). The refrigerant compressed in the mechanism sections (24, 25) is discharged through the discharge pipe (31) again.

Advantages of First Embodiment

As described above, in the first embodiment, the seal ring (81, 91) forming the intermediate back pressure chamber (85, 95) on the back side of the fixed end plate section (51*a*, 55*a*) is provided, resulting in the smaller separating force acting on the cylinder (52, 56) and the smaller pressing force of the press mechanism (80, 90) while the intermediate injection operation is stopped. Thus, in the conventional compressor in which the pressing force is obtained only by high-pressure refrigerant machine oil injected to the back side of the end plate section (52*a*, 56*a*), the pressing force of the press mechanism (80, 90) is approximately constant before and after the intermediate injection operation is stopped. On the other hand, in the compressor (20) of the first embodiment, the pressing force becomes smaller while the intermediate injection operation is stopped, resulting in a smaller difference between the pressing force and the separating force while the intermediate injection operation is stopped. Thus, while the intermediate injection operation is stopped, friction force caused due to the difference between the pressing force and the separating force becomes smaller, thereby reducing an energy loss in the compression mechanism (30).

In the first embodiment, as the compressor (20) of the refrigeration apparatus (1) performing the intermediate injection operation, the compressor (20) is applied, in which the pressing force of the press mechanism (80, 90) becomes smaller while the intermediate injection operation is stopped. This reduces the energy loss in the compressor (20) while the intermediate injection operation is stopped, thereby improving operational efficiency of the refrigeration apparatus (1).

Second Embodiment

An air conditioner (1) of a second embodiment has a different configuration from that of the compressor (20) of the first embodiment. Differences from the first embodiment will be described below.

Figure 5:
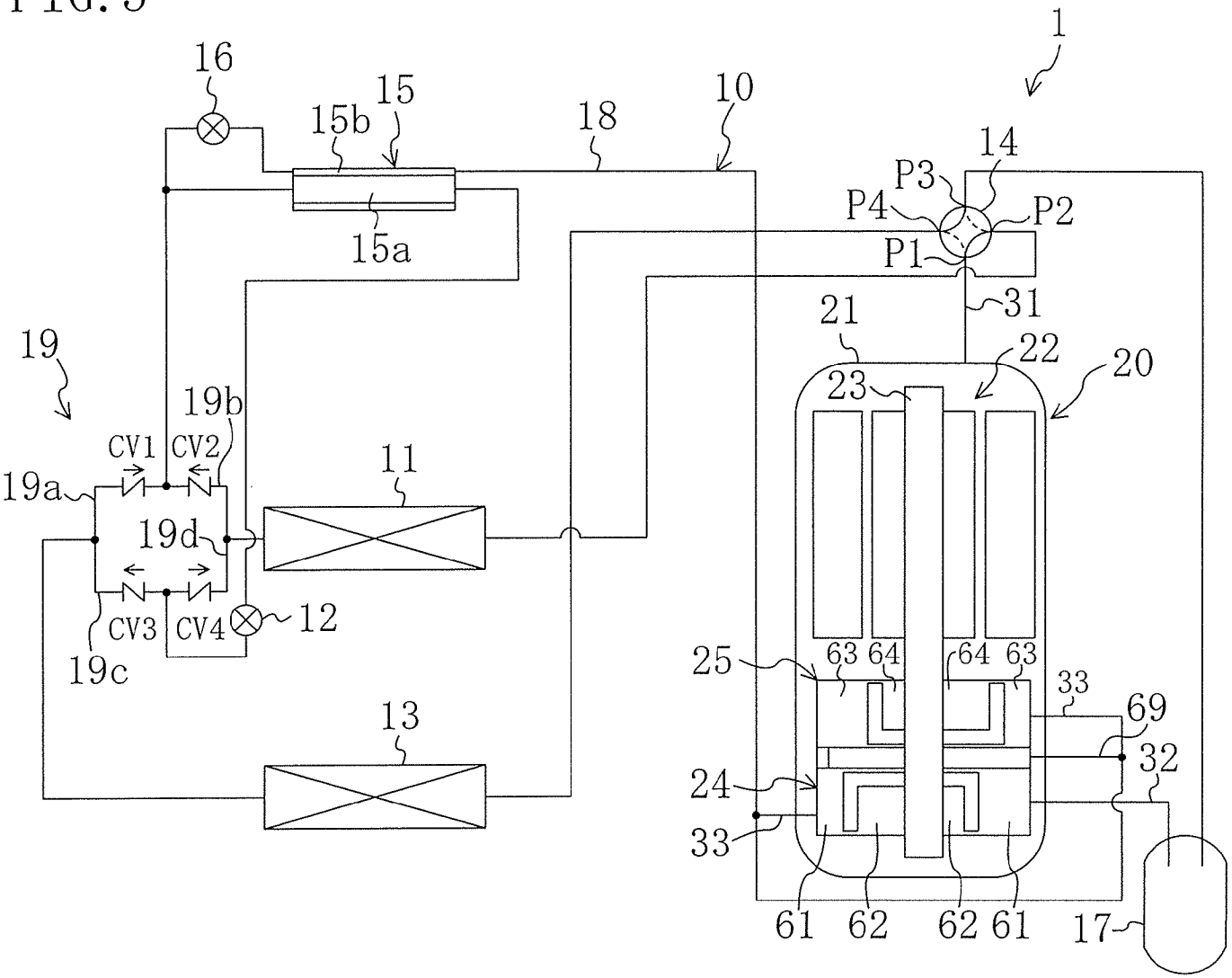
FIG. 5 is a piping system diagram of a refrigerant circuit of an air conditioner of the second embodiment.

In the compressor (20) of the second embodiment, as illustrated in FIG. 5, a first lower-stage compression chamber (61) and a second lower-stage compression chamber (62) are formed in a first mechanism section (24), and a first higher-stage compression chamber (63) and a second higher-stage compression chamber (64) are formed in a second mechanism section (25).

A suction pipe (32) is connected to a suction side of the first mechanism section (24). A discharge side of the first mechanism section (24) is connected to a suction side of the second mechanism section (25) through an intermediate-pressure access pipe (33).

Figure 6:
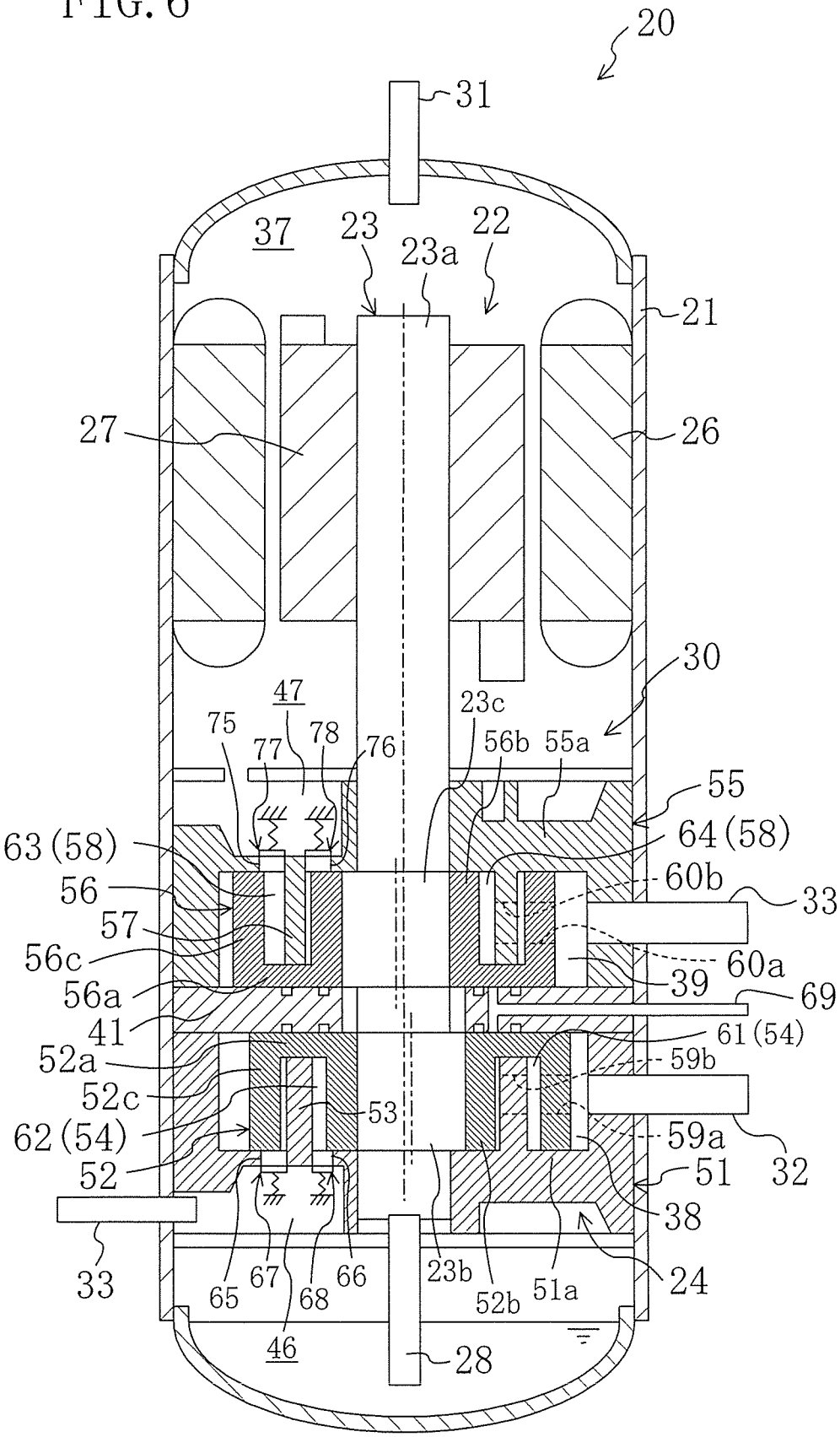
FIG. 6 is a longitudinal sectional view of a compressor of the second embodiment.
Figure 7:
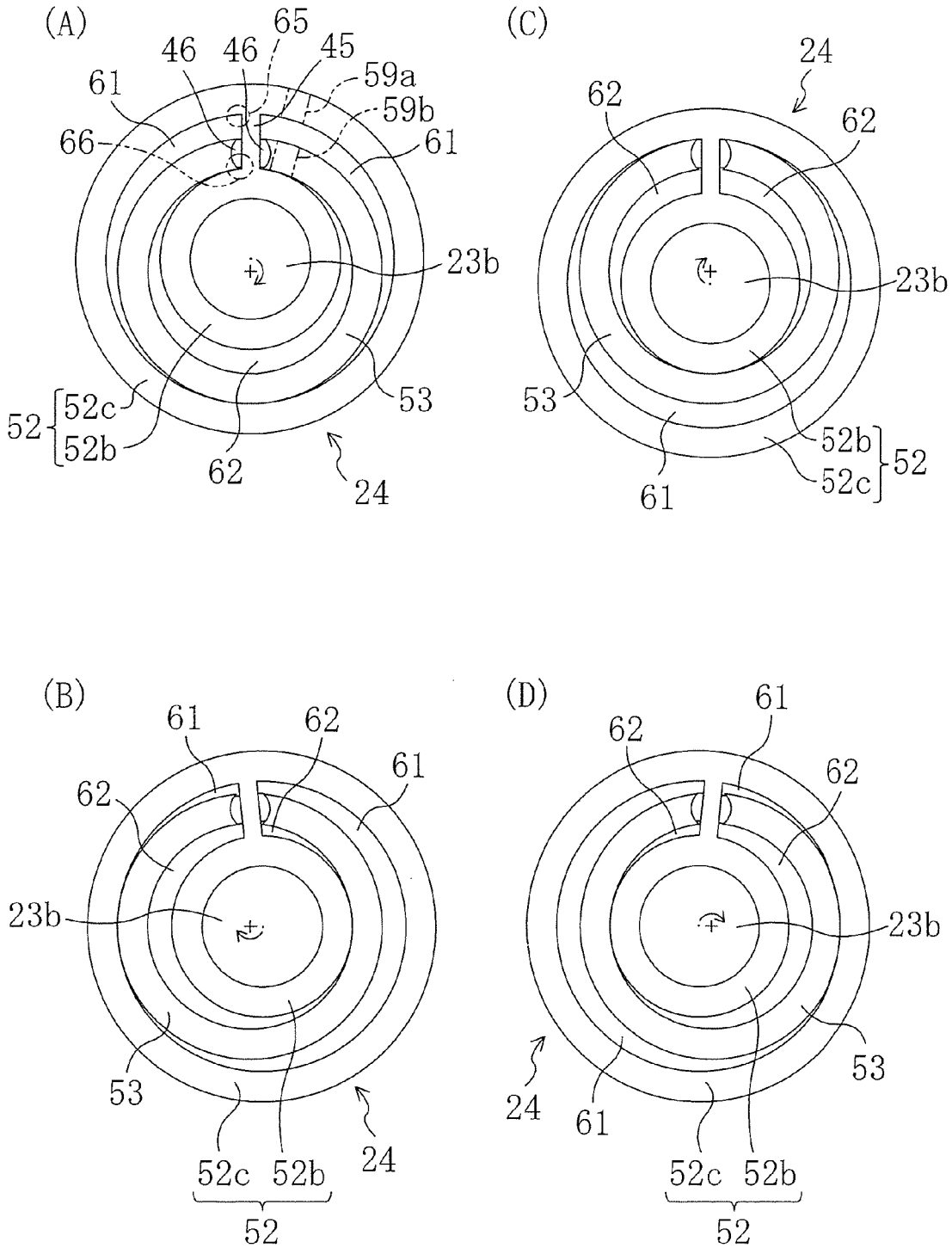
FIG. 7 are cross-sectional views of a first mechanism section (second mechanism section) of the second embodiment.

As illustrated in FIGS. 6 and 7, in the first mechanism section (24), the first lower-stage compression chamber (61) is formed between an outer circumferential surface of a first piston (53) and an outer wall of a first cylinder chamber (54), and the second lower-stage compression chamber (62) is formed between an inner circumferential surface of the first piston (53) and an inner wall of the first cylinder chamber (54).

In a first cylinder (52), a first outer communication path (59*a*) is formed in an outer cylinder section (52*c*), and a first inner communication path (59*b*) is formed in an inner cylinder section (52*b*). The first outer communication path (59*a*) allows a suction space (38) outside the first cylinder (52) to communicate with a suction side of the first lower-stage compression chamber (61). The first inner communication path (59*b*) allows the suction side of the first lower-stage compression chamber (61) to communicate with a suction side of the second lower-stage compression chamber (62). In the first mechanism section (24), the suction side of the first lower-stage compression chamber (61) is connected to the suction pipe (32) through the first outer communication path (59*a*). The suction side of the second lower-stage compression chamber (62) is connected to the suction pipe (32) through the first outer communication path (59*a*) and the first inner communication path (59*b*).

In the first mechanism section (24), an outer discharge port (65) and an inner discharge port (66) are formed in a first housing (51). The outer discharge port (65) allows a discharge side of the first lower-stage compression chamber (61) to communicate with a first discharge space (46). A first discharge valve (67) is provided in the outer discharge port (65). The first discharge valve (67) opens the outer discharge port (65) when refrigerant pressure on the discharge side of the first lower-stage compression chamber (61) is equal to or greater than refrigerant pressure of the first discharge space (46). On the other hand, the inner discharge port (66) allows a discharge side of the second lower-stage compression chamber (62) to communicate with the first discharge space (46). A second discharge valve (68) is provided in the inner discharge port (66). The second discharge valve (68) opens the inner discharge port (66) when refrigerant pressure on the discharge side of the second lower-stage compression chamber (62) is equal to or greater than refrigerant pressure of the first discharge space (46). The intermediate-pressure access pipe (33) opens to the first discharge space (46).

In the second mechanism section (25), the first higher-stage compression chamber (63) is formed between an outer circumferential surface of a second piston (57) and an outer wall of a second cylinder chamber (58), and the second higher-stage compression chamber (64) is formed between an inner circumferential surface of the second piston (57) and an inner wall of the second cylinder chamber (58).

In a second cylinder (56), a second outer communication path (60*a*) is formed in an outer cylinder section (56*c*), and a second inner communication path (60*b*) is formed in an inner cylinder section (56*b*). The second outer communication path (60*a*) allows a suction space (39) outside the second cylinder (56) to communicate with a suction side of the first higher-stage compression chamber (63). The second inner communication path (60*b*) allows the suction side of the first higher-stage compression chamber (63) to communicate with a suction side of the second higher-stage compression chamber (64). In the second mechanism section (25), the suction side of the first higher-stage compression chamber (63) is connected to the intermediate-pressure access pipe (33) through the second outer communication path (60*a*). The suction side of the second higher-stage compression chamber (64) is connected to the intermediate-pressure access pipe (33) through the second outer communication path (60*a*) and the second inner communication path (60*b*).

In the second mechanism section (25), an outer discharge port (75) and an inner discharge port (76) are formed in a second housing (55). The outer discharge port (75) allows a discharge side of the first higher-stage compression chamber (63) to communicate with a second discharge space (47). A third discharge valve (77) is provided in the outer discharge port (75). The third discharge valve (77) opens the outer discharge port (75) when refrigerant pressure on the discharge side of the first higher-stage compression chamber (63) is equal to or greater than refrigerant pressure of the second discharge space (47). On the other hand, the inner discharge port (76) allows a discharge side of the second higher-stage compression chamber (64) to communicate with the second discharge space (47). A fourth discharge valve (78) is provided in the inner discharge port (76). The fourth discharge valve (78) opens the inner discharge port (76) when refrigerant pressure on the discharge side of the second higher-stage compression chamber (64) is equal to or greater than refrigerant pressure of the second discharge space (47). The second discharge space (47) communicate with an internal space (37).

Press mechanisms (80, 90) of the second embodiment have the same configuration as that of the first embodiment. In the second embodiment, the first press section (80) provided for the first mechanism section (24) in which only the lower-stage compression chambers (61, 62) are formed includes a first inner seal ring (81*a*) and a first outer seal ring (81*b*) forming the intermediate back pressure chamber (85). In addition, the second press section (90) provided for the second mechanism section (25) in which only the higher-stage compression chambers (63, 64) are formed includes a second inner seal ring (91*a*) and a second outer seal ring (91*b*) forming the intermediate back pressure chamber (95). This allows the smaller separating force acting on the cylinder (52, 56) and the smaller pressing force of the press mechanism (80, 90) in the mechanism section (24, 25) while the intermediate injection operation is stopped.

Here, if the suction volume ratio of the higher-stage compression chamber (63, 64) to the lower-stage compression chamber (61, 62) is, e.g., 1.0, pressures on the suction and discharge sides of the lower-stage compression chamber (61, 62) become equal to each other while the intermediate injection operation is stopped, resulting in the pressure of intermediate-pressure refrigerant equal to the pressure of refrigerant sucked into the lower-stage compression chamber (61, 62). That is, while the intermediate injection operation is stopped, refrigerant is not substantially compressed in the first mechanism section (24), and the first cylinder (52) is at idle. In the second embodiment, the pressing force of the first press section (80) becomes smaller while the intermediate injection operation is stopped, thereby reducing the energy loss in the idling first cylinder (52).

Advantages of Second Embodiment

As described above, in the second embodiment, the seal ring (91) is provided on the back side of the movable end plate section (56*a*) for the second mechanism section (25) having the greater rate of change in separating force by stopping the intermediate injection operation as compared to the rate in the first mechanism section (24). That is, the seal ring (91) is provided on the back side of the movable end plate section (56*a*) for the second mechanism section (25) in which, if the intermediate back pressure chamber (85, 95) is not formed on the back side of the movable end plate section (52*a*, 56*a*) by the dividing member (81, 91) of the second embodiment, the energy loss due to the difference between the pressing force and the separating force increases while the intermediate injection operation is stopped as compared to the first mechanism section (24). Thus, an effect by forming the intermediate back pressure chamber (85, 95) in the second mechanism section (25) is greater than that in the first mechanism section (24), thereby effectively reducing the energy loss in the compression mechanism (30).

In the second embodiment, the seal ring (81) is also provided not only on the back side of the end plate section (56*a*) of the second mechanism section (25), but also on the back side of the movable end plate section (52*a*) of the first mechanism section (24). Thus, the energy loss while the intermediate injection operation is stopped can be reduced not only in the second mechanism section (25) but also in the first mechanism section (24), thereby reducing the energy loss in the compression mechanism (30).

In the second embodiment, the seal ring (81) is provided on the back side of the movable end plate section (52*a*) of the first mechanism section (24) in which a workload required for refrigerant compression is decreased in response to the stoppage of the intermediate injection operation, resulting in the smaller pressing force acting on the movable member (52) while the intermediate injection operation is stopped. Thus, in the first mechanism section (24), friction force caused due to the difference between the pressing force and the separating force becomes smaller than that of the conventional compressor, thereby reducing degradation of compression efficiency while the intermediate injection operation is stopped.

Third Embodiment

A third embodiment of the present invention is an air conditioner (1) including a compressor (20) of the present invention. Unlike the first and second embodiments, the compressor (20) of the third embodiment includes a mechanism section (24, 25) employing a movable piston system in which, among cylinders (52, 56) and pistons (53, 57), the pistons (53, 57) eccentrically rotate. Differences from the second embodiment will be described below.

Figure 8:
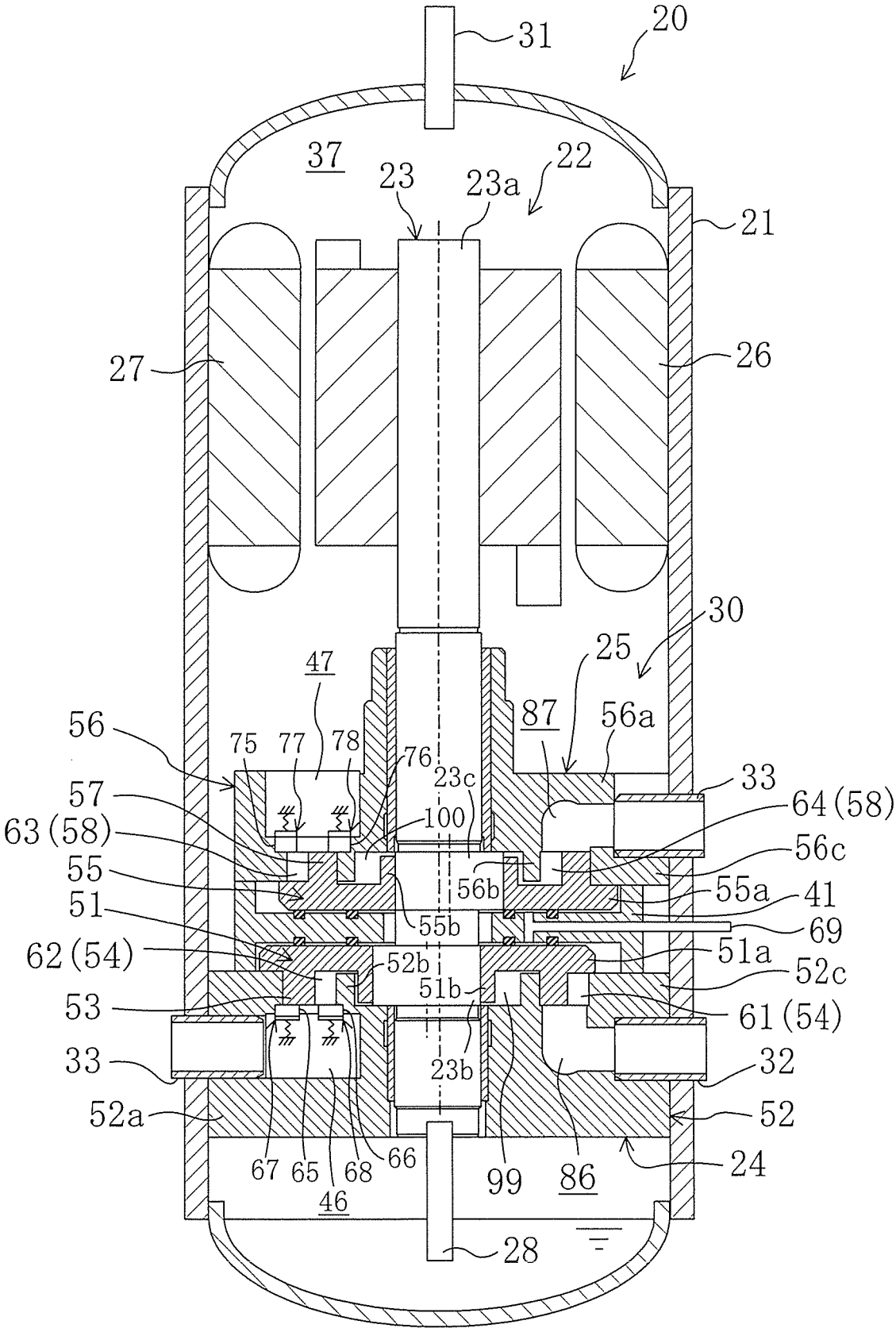
FIG. 8 is a longitudinal sectional view of a compressor of a third embodiment.
Figure 9:
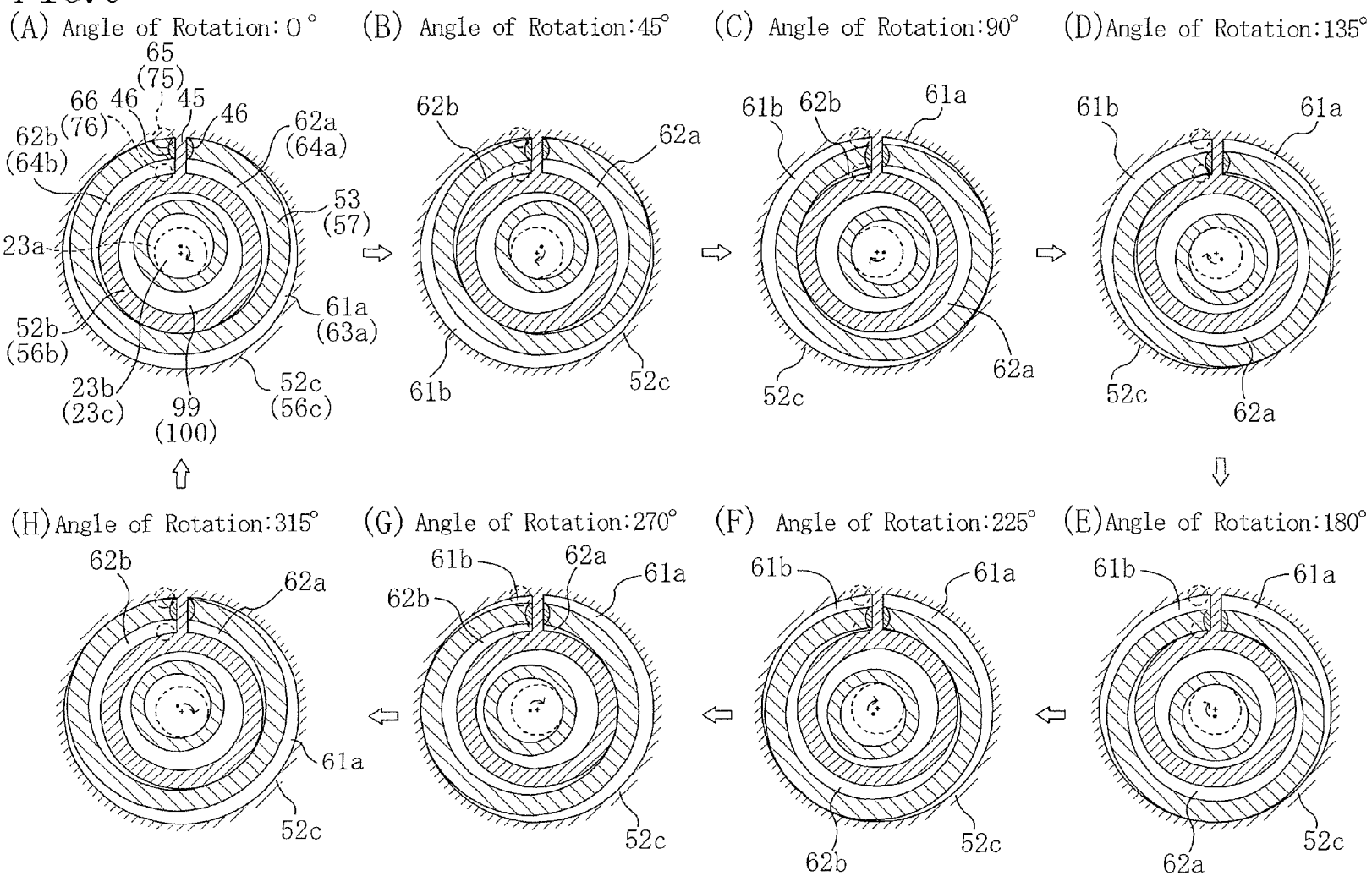
FIG. 9 are cross-sectional views of a first mechanism section (second mechanism section) of the third embodiment.

As illustrated in FIGS. 8 and 9, the first mechanism section (24) includes the first cylinder (52) which is a fixed member fixed to a casing (21); and a first movable member (51) which has the circular first piston (53), and which is driven by a drive shaft (23). The first mechanism section (24) is provided so that a back surface of a movable end plate section (51*a*) which will be described later faces the second mechanism section (25) side.

The first cylinder (52) includes a discoid fixed end plate section (52*a*); a circular inner cylinder section (52*b*) upwardly protruding from a position closer to an inside of an upper surface of the fixed end plate section (52*a*); and a circular outer cylinder section (52*c*) upwardly protruding from an outer circumferential section of the upper surface of the fixed end plate section (52*a*). The first cylinder (52) includes a circular first cylinder chamber (54) between the inner cylinder section (52*b*) and the outer cylinder section (52*c*).

On the other hand, the first movable member (51) includes a discoid movable end plate section (51*a*); the first piston (53); and a circular protrusion (51*b*) downwardly protruding from an inner circumferential end of a lower surface of the movable end plate section (51*a*). The movable end plate section (51*a*) and the fixed end plate section (52*a*) face the first cylinder chamber (54). The first piston (53) downwardly protrudes from a position slightly closer to an outer circumference of the lower surface of the movable end plate section (51*a*). The first piston (53) is accommodated in the first cylinder chamber (54) so as to be eccentric to the first cylinder (52), and divides the first cylinder chamber (54) into a first lower-stage compression chamber (61) outside the first piston (53), and a second lower-stage compression chamber (62) inside the first piston (53).

In the first piston (53) and the first cylinder (52), in a state in which an outer circumferential surface of the first piston (53) substantially contacts an inner circumferential surface of the outer cylinder section (52*c*) at one point (i.e., a state in which, even if there is a micron-order space, no disadvantage is caused due to refrigerant leakage in such a space), an inner circumferential surface of the first piston (53) substantially contacts an outer circumferential surface of the inner cylinder section (52*b*) at one point which is 180° out of phase with the above-described contact point. The second mechanism section (25) is in the same state, and each of the mechanism sections (24, 25) of the foregoing embodiments is also in the same state.

A first eccentric section (23*b*) is fitted into the circular protrusion (51*b*). The first movable member (51) eccentrically rotates about a shaft center of a main shaft section (23*a*) in response to rotation of the drive shaft (23). In the first mechanism section (24), a space (99) is formed between the circular protrusion (51*b*) and the inner cylinder section (52*b*), but refrigerant is not compressed in the space (99).

As illustrated in FIG. 9, the first mechanism section (24) includes a blade (45) extending from the outer circumferential surface of the inner cylinder section (52*b*) to the inner circumferential surface of the outer cylinder section (52*c*). The blade (45) is integrally formed with the first cylinder (52). The blade (45) is arranged in the first cylinder chamber (54). The blade (45) divides the first lower-stage compression chamber (61) into a low-pressure chamber (61*a*) and a high-pressure chamber (61*b*), and divides the second lower-stage compression chamber (62) into a low-pressure chamber (62*a*) and a high-pressure chamber (62*b*). The blade (45) is inserted into a split portion of the first piston (53) formed in a C-shape, i.e., a part of the annular ring splits. Semicircular bushes (46) are fitted in the split portion of the first piston (53) so as to sandwich the blade (45). The bushes (46) can swing along an end surface of the first piston (53). This allows the first piston (53) to move back and forth in the extending direction of the blade (45), and to swing together with the bushes (46).

A suction pipe (32) is connected to the first mechanism section (24). The suction pipe (32) is connected to a first connection path (86) formed in the fixed end plate section (52*a*). An inlet side of the first connection path (86) extends in the radial direction of the fixed end plate section (52*a*), and upwardly bends in the middle thereof. An outlet side of the first connection path (86) extends in the axial direction of the fixed end plate section (52*a*). An outlet end of the first connection path (86) opens to both of the first lower-stage compression chamber (61) and the second lower-stage compression chamber (62).

In addition, the first mechanism section (24) includes an outer discharge port (65) for discharging refrigerant from the first lower-stage compression chamber (61) on an outer side; an inner discharge port (66) for discharging refrigerant from the second lower-stage compression chamber (62) on an inner side; and a first discharge space (46) to which both of the outer discharge port (65) and the inner discharge port (66) open. The outer discharge port (65) allows the high-pressure chamber (61*b*) of the first lower-stage compression chamber (61) to communicate with the first discharge space (46). A first discharge valve (67) is provided in the outer discharge port (65). On the other hand, the inner discharge port (66) allows the high-pressure chamber (62*b*) of the second lower-stage compression chamber (62) to communicate with the first discharge space (46). A second discharge valve (68) is provided in the inner discharge port (66). An inlet end of an intermediate-pressure access pipe (33) opens to the first discharge space (46).

According to the foregoing configuration, when rotating the drive shaft (23), the first piston (53) eccentrically rotates in the order illustrated in FIGS. 9(A)-9(H). In response to such eccentric rotation, low-pressure refrigerant injected through the suction pipe (32) is compressed in the first lower-stage compression chamber (61) and the second lower-stage compression chamber (62). The refrigerant discharged from the first lower-stage compression chamber (61) and the second lower-stage compression chamber (62) flows into the intermediate-pressure access pipe (33).

The second mechanism section (25) includes the same machine elements as those of the first mechanism section (24). The second mechanism section (25) is vertically flipped with respect to the first mechanism section (24) with a middle plate (41) which will be described later being interposed therebetween.

Specifically, the second mechanism section (25) includes a second cylinder (56) which is a fixed member fixed to the casing (21); and a second movable member (55) which has a circular second piston (57), and which is driven by the drive shaft (23). The second mechanism section (25) is provided so that a back side of a movable end plate section (55*a*) which will be described later faces the first mechanism section (24) side.

The second cylinder (56) includes a discoid fixed end plate section (56*a*); a circular inner cylinder section (56*b*) downwardly protruding from a position closer to an inside of a lower surface of the fixed end plate section (56*a*); and a circular outer cylinder section (56*c*) downwardly protruding from an outer circumferential section of the lower surface of the fixed end plate section (56*a*). The second cylinder (56) includes a circular second cylinder chamber (58) between the inner cylinder section (56*b*) and the outer cylinder section (56*c*).

On the other hand, the second movable member (55) includes the discoid movable end plate section (55*a*); the second piston (57); and a circular protrusion (55*b*) upwardly protruding from an inner circumferential end of an upper surface of the movable end plate section (55*a*). The movable end plate section (55*a*) and the fixed end plate section (56*a*) face the second cylinder chamber (58). The second piston (57) upwardly protrudes from a position slightly closer to an outer circumference of the upper surface of the movable end plate section (55*a*). The second piston (57) is accommodated in the second cylinder chamber (58) so as to be eccentric to the second cylinder (56), and divides the second cylinder chamber (58) into a first higher-stage compression chamber (63) outside the second piston (57), and a second higher-stage compression chamber (64) inside the second piston (57). A second eccentric section (23*c*) is fitted into the circular protrusion (55*b*). The second movable member (55) eccentrically rotates about the shaft center of the main shaft section (23*a*) in response to the rotation of the drive shaft (23). In the second mechanism section (25), a space (100) is formed between the circular protrusion (55*b*) and the inner cylinder section (56*b*), but refrigerant is not compressed in the space (100).

In addition, the second mechanism section (25) includes a blade (45) extending from an outer circumferential surface of the inner cylinder section (56*b*) to an inner circumferential surface of the outer cylinder section (56*c*). The blade (45) is integrally formed with the second cylinder (56). The blade (45) is arranged in the second cylinder chamber (58). The blade (45) divides the first higher-stage compression chamber (63) into a low-pressure chamber (63*a*) and a high-pressure chamber (63*b*), and divides the second higher-stage compression chamber (64) into a low-pressure chamber (64*a*) and a high-pressure chamber (64*b*). The blade (45) is inserted into a split portion of the second piston (57) formed in a C-shape, i.e., a part of the annular ring splits. Semicircular bushes (46) are fitted in the split portion of the second piston (57) so as to sandwich the blade (45). The bushes (46) can swing along an end surface of the second piston (57). This allows the second piston (57) to move back and forth in the extending direction of the blade (45), and to swing together with the bushes (46).

The intermediate-pressure access pipe (33) is connected to the second mechanism section (25). The intermediate-pressure access pipe (33) is connected to a second connection path (87) formed in the fixed end plate section (56*a*). An inlet side of the second connection path (87) extends in the radial direction of the fixed end plate section (56*a*), and downwardly bends in the middle thereof. An outlet side of the second connection path (87) extends in the axial direction of the fixed end plate section (56*a*). An outlet end of the second connection path (87) opens to both of the first higher-stage compression chamber (63) and the second higher-stage compression chamber (64).

In addition, the second mechanism section (25) includes an outer discharge port (75) for discharging refrigerant from the first higher-stage compression chamber (63) on an outer side; an inner discharge port (76) for discharging refrigerant from the second higher-stage compression chamber (64) on an inner side; and a second discharge space (47) to which both of the outer discharge port (75) and the inner discharge port (76) open. The outer discharge port (75) allows the high-pressure chamber (63*b*) of the first higher-stage compression chamber (63) to communicate with the second discharge space (47). A third discharge valve (77) is provided in the outer discharge port (75). On the other hand, the inner discharge port (76) allows the high-pressure chamber (64*b*) of the second higher-stage compression chamber (64) to communicate with the second discharge space (47). A fourth discharge valve (78) is provided in the inner discharge port (76). The second discharge space (47) communicates with a discharge pipe (31) through an internal space (37).

According to the foregoing configuration, when rotating the drive shaft (23), the second piston (57) eccentrically rotates as in the first piston (53). In response to such eccentric rotation, intermediate-pressure refrigerant injected through the intermediate-pressure access pipe (33) is compressed in the first higher-stage compression chamber (63) and the second higher-stage compression chamber (64). The refrigerant discharged from the first higher-stage compression chamber (63) and the second higher-stage compression chamber (64) flows into the discharge pipe (31).

Figure 10:
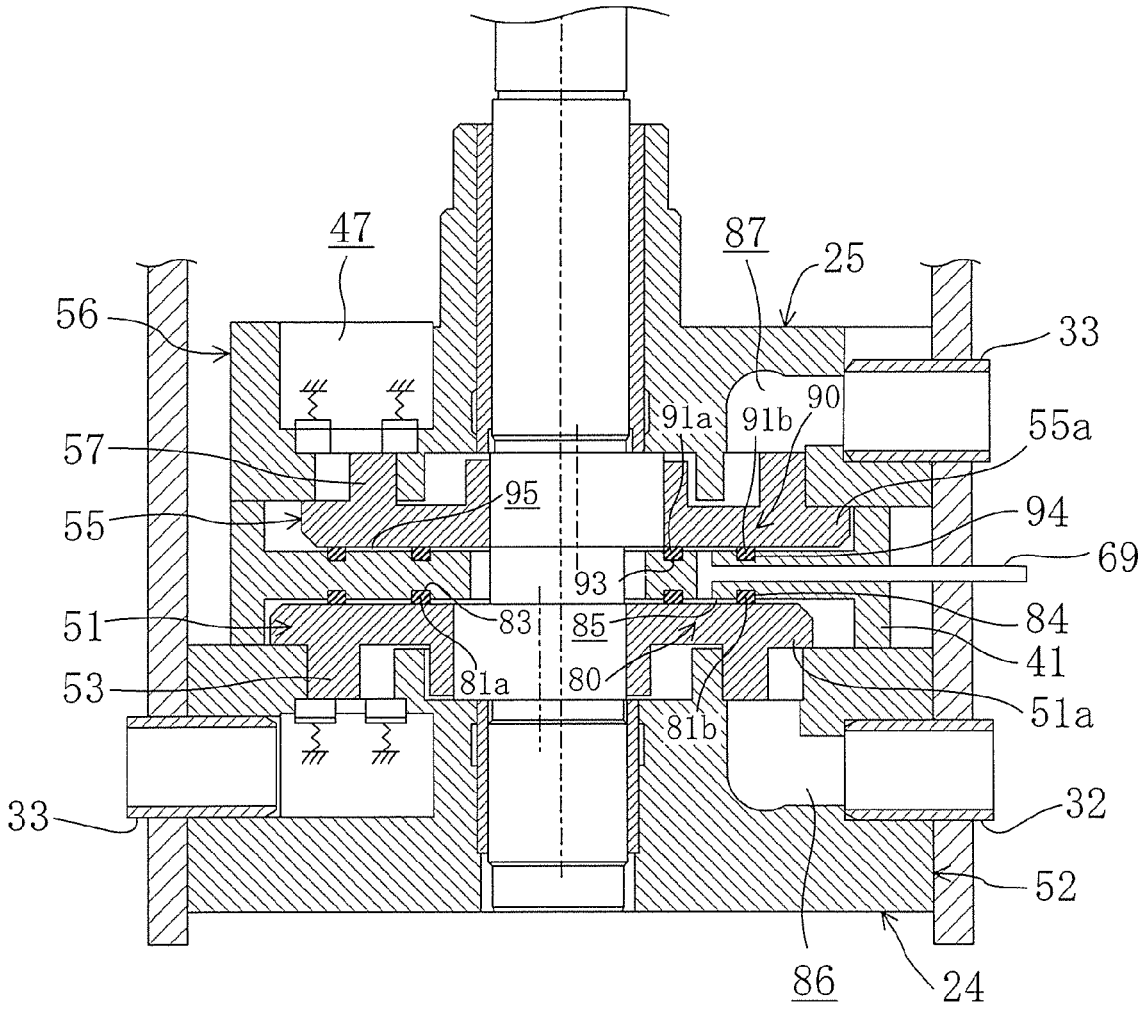
FIG. 10 is an enlarged sectional view of a press mechanism of the third embodiment.

In the third embodiment, as illustrated in FIG. 10, press mechanisms (80, 90) including a first press section (80) and a second press section (90) are provided in the middle plate (41). A configuration of each of the press sections (80, 90) is the same as those of the first and second embodiments, and therefore the description of such a configuration is not repeated.

Other Embodiments

The foregoing embodiments may have the following configurations.

In the foregoing embodiments, refrigerant filling the refrigerant circuit (10) may be refrigerant other than carbon dioxide (e.g., Freon refrigerant). In such a case, the compressor (20) is configured for Freon refrigerant. The compressor (20) for Freon refrigerant is designed so that the suction volume ratio of the higher-stage compression chamber (63, 64) to the lower-stage compression chamber (61, 62) is a value smaller than that of the compressor for carbon dioxide (e.g., 0.7).

Figure 11:
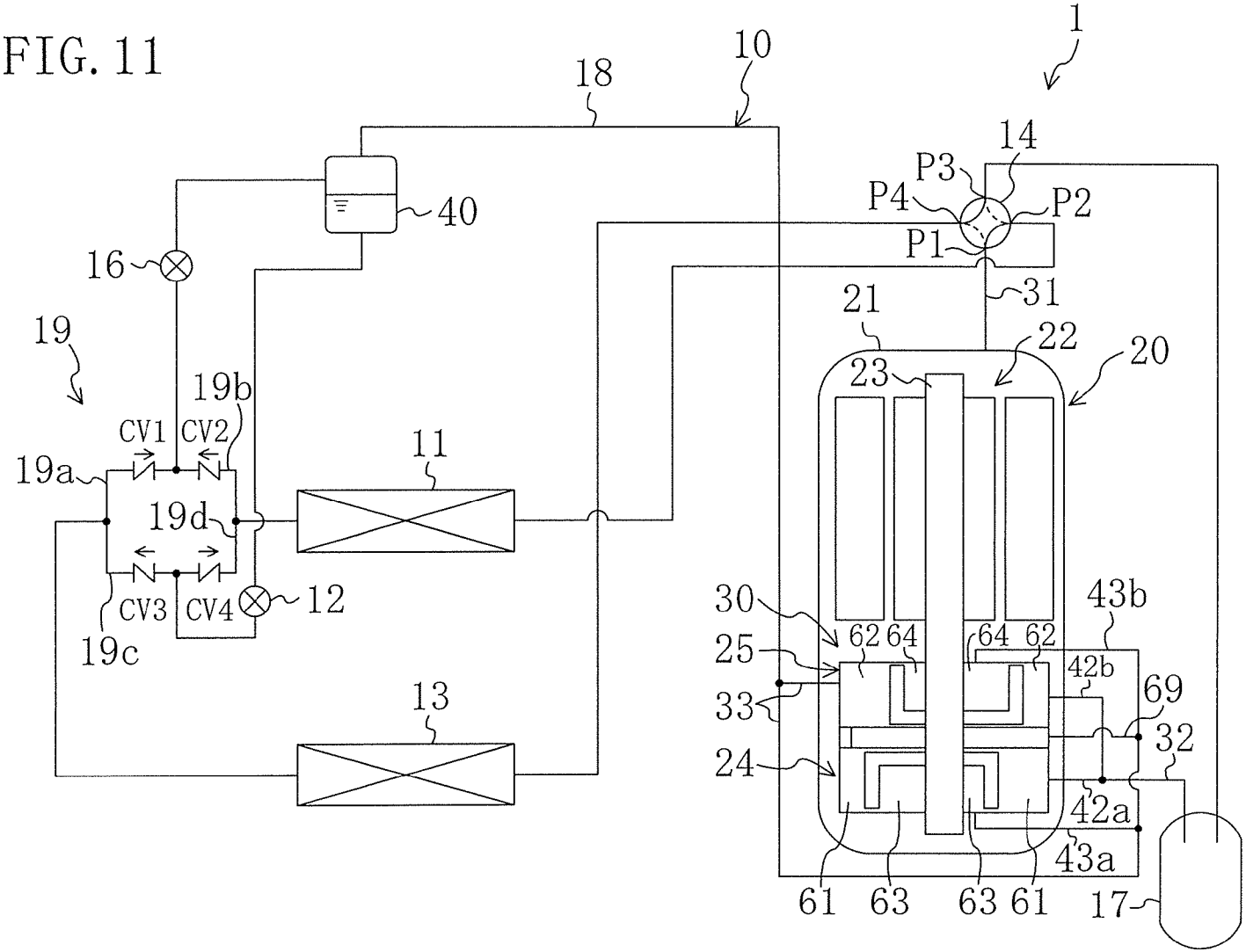
FIG. 11 is a piping system diagram of a refrigerant circuit of an air conditioner of other embodiment.

In the foregoing embodiments, as illustrated in FIG. 11, a gas-liquid separator (40) may be used to obtain intermediate-pressure gaseous refrigerant sent to the compressor (20).

In the foregoing embodiments, the compressor (20) may be a low-pressure dome type compressor.

In the second and third embodiments, the intermediate back pressure chamber (85) may be formed only on the back side of the movable end plate section (51*a*, 52*a*) of the first mechanism section (24) of the first mechanism section (24) and the second mechanism section (25); or the intermediate back pressure chamber (95) may be formed only on the back side of the movable end plate section (55*a*, 56*a*) of the second mechanism section (25).

In the foregoing embodiments, one of the mechanism sections (24, 25) may be a mechanism section in which there is no end plate section in the movable member (51, 52, 55, 56) and the fixed member (51, 52, 55, 56) (e.g., rotary fluid machine). In such a case, the intermediate back pressure chamber (85, 95) is formed on the back side of the movable end plate section (51*a*, 52*a*, 55*a*, 56*a*) of the remaining mechanism section (24, 25) including the end plate sections.

In the first embodiment, the compression mechanism (30) may have a single mechanism section (24, 25).

In the second embodiment, one or both of the mechanism sections (24, 25) may be scroll-type fluid machine(s). In such a case, the intermediate back pressure chamber (85, 95) is formed on a back side of a movable scroll (52, 56) of the scroll fluid machine.

The foregoing embodiments have been set forth merely for purposes of preferred examples in nature, and are not intended to limit the scope, applications, and use of the invention.

INDUSTRIAL APPLICABILITY

As described above, the present invention is useful for the compressor performing the two-stage compression of refrigerant, and the refrigeration apparatus including the compressor.

What is claimed is:

1. A compressor comprising:

a compression mechanism configured to be disposed in a refrigerant circuit in which a refrigeration cycle is performed, the compression mechanism including at least one lower-stage compression chamber and at least one higher-stage compression chamber, the lower and higher stage compression chambers being arranged and configured such that refrigerant compressed in the lower-stage compression chamber is further compressed in the higher-stage compression chamber; and an intermediate injection pipe connected in the refrigerant circuit, the intermediate injection pipe being arranged and configured to inject intermediate-pressure refrigerant of the refrigerant circuit between the lower-stage compression chamber and the higher-stage compression chamber, the compression mechanism further including at least one fixed member having a fixed end plate section provided on base end side thereof, at least one movable member having a movable end plate section facing the fixed end plate with at least one of the compression chambers being interposed therebetween on the base end side of the movable plate section, the movable member being arranged and configured to eccentrically move relative to the fixed member to compress refrigerant, at least one intermediate back pressure chamber formed so as to face a back surface of the movable end plate section, the intermediate back pressure chamber communicating with a discharge side of the lower-stage compression chamber, and arranged such that internal pressure of the intermediate back pressure chamber acts on the movable end plate section to press the movable member against the fixed member, and a first mechanism section and a second mechanism section, each of the first and second mechanism sections including at least one fixed member and at least one movable member, the intermediate back pressure chamber being formed on a back side of the movable end plate section of at least one of the first mechanism section and the second mechanism section, the lower-stage compression chamber being formed only in the first mechanism section;

the higher-stage compression chamber being formed only in the second mechanism section; and the intermediate back pressure chamber being formed on the back side of the movable end plate section of the second mechanism section.

2. The compressor of claim 1, wherein, the at least one intermediate back pressure chamber includes an additional chamber formed on the back side of the movable end plate section of the first mechanism section.

3. The compressor of claim 1, wherein carbon dioxide refrigerant is compressed by the compression mechanism.

4. A refrigeration apparatus including a refrigerant circuit having the compressor of claim 1, the refrigerant circuit further including an opening/closing mechanism arranged and configured to open/close the intermediate injection pipe.

5. A compressor comprising:

a compression mechanism configured to be disposed in a refrigerant circuit in which a refrigeration cycle is performed the compression mechanism including at least one lower-stage compression chamber and at least one higher-stage compression chamber, the lower and higher stage compression chambers being arranged and configured such that refrigerant compressed in the lower-stage compression chamber is further compressed in the higher-stage compression chamber; and an intermediate injection pipe connected in the refrigerant circuit, the intermediate injection pipe being arranged and configured to inject intermediate-pressure refrigerant of the refrigerant circuit between the lower-stage compression chamber and the higher-stage compression chamber, the compression mechanism further including at least one fixed member having a fixed end plate section provided on base end side thereof, at least one movable member having a movable end plate section facing the fixed end plate with at least one of the compression chambers being interposed therebetween on the base end side of the movable plate section, the movable member being arranged and configured to eccentrically move relative to the fixed member to compress refrigerant, at least one intermediate back pressure chamber formed so as to face a back surface of the movable end plate section, the intermediate back pressure chamber communicating with a discharge side of the lower-stage compression chamber, and arranged such that internal pressure of the intermediate back pressure chamber acts on the movable end plate section to press the movable member against the fixed member, and a first mechanism section and a second mechanism section, each of the first and second mechanism sections including at least one fixed member and at least one movable member, the intermediate back pressure chamber being formed on a back side of the movable end plate section of at least one of the first mechanism section and the second mechanism section, the lower-stage compression chamber being formed only in the first mechanism section;

the higher-stage compression chamber being formed only in the second mechanism section; and the intermediate back pressure chamber being firmed on the back side of the movable end plate section of the first mechanism section.

6. The compressor of claim 5, wherein carbon dioxide refrigerant is compressed by the compression mechanism.

7. A refrigeration apparatus including a refrigerant circuit having the compressor of claim 5, the refrigerant circuit further including an opening/closing mechanism arranged and configured to open/close the intermediate injection pipe.

* * * * *